US008512516B2

(12) United States Patent
Murray et al.

(10) Patent No.: US 8,512,516 B2
(45) **Date of Patent: *Aug. 20, 2013**

(54) HIGH SOLIDS FABRIC CREPE PROCESS FOR PRODUCING ABSORBENT SHEET WITH IN-FABRIC DRYING

(75) Inventors: Frank C. Murray, Marietta, GA (US); Greg A. Wendt, Neenah, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/397,720

(22) Filed: Feb. 16, 2012

(65) Prior Publication Data

US 2012/0160434 A1 Jun. 28, 2012

Related U.S. Application Data

(60) Continuation of application No. 12/321,448, filed on Jan. 21, 2009, now Pat. No. 8,142,612, which is a division of application No. 11/151,761, filed on Jun. 14, 2005, now Pat. No. 7,503,998.

(60) Provisional application No. 60/580,847, filed on Jun. 18, 2004.

(51) Int. Cl.

| | |
|---|---|
| ***D21H 27/02*** | (2006.01) |
| ***D21F 11/00*** | (2006.01) |
| ***B31F 1/16*** | (2006.01) |

(52) U.S. Cl.

USPC ..... 162/113; 162/111; 162/116; 162/207

(58) Field of Classification Search

USPC ..... 162/109–117, 197, 205–207, 270, 162/271, 280, 306, 308, 312; 428/152–154, 428/156, 174; 264/282; 156/183

See application file for complete search history.

(56) References Cited

U.S. PATENT DOCUMENTS

| | | | |
|---|---|---|---|
| 2,926,116 | A | 2/1960 | Keim |
| 3,058,873 | A | 10/1962 | Keim et al. |

(Continued)

FOREIGN PATENT DOCUMENTS

| | | | |
|---|---|---|---|
| CA | 2053505 | | 4/1992 |
| SU | 1708641 | A1 | 1/1992 |

(Continued)

OTHER PUBLICATIONS

Espy, Herbert H., "Chapter 2: Alkaline-Curing Polymeric Amine-Epichlorohydrin Resins," in Wet Strength Resins and Their Application, L. Chan, Editor, 1994.

(Continued)

*Primary Examiner* — Eric Hug
(74) *Attorney, Agent, or Firm* — Laura L. Bozek

(57) ABSTRACT

A method of making a cellulosic web having an elevated absorbency includes forming a nascent web having a random distribution of fiber orientation from a papermaking furnish, non-compactively drying the nascent web to a consistency of from about 30 to about 60 percent, thereafter, transferring the nascent web to a translating transfer surface that is moving at a transfer surface speed, and fabric-creping the nascent web from the transfer surface at a consistency of from about 30 to about 60 percent utilizing a creping fabric, the fabric-creping step occurring under pressure in a fabric creping nip defined between the transfer surface and the creping fabric, such that the nascent web is creped from the transfer surface and redistributed on the creping fabric to form a creped wet web. The creped wet web is dried while the web is held in the creping fabric.

31 Claims, 17 Drawing Sheets

(56) References Cited

U.S. PATENT DOCUMENTS 3,432,936 A 3/1969 Cole et al.
3,545,705 A 12/1970 Hodgson
3,549,742 A 12/1970 Benz
3,556,932 A 1/1971 Coscia et al.
3,556,933 A 1/1971 Williams et al.
3,700,623 A 10/1972 Keim
3,772,076 A 11/1973 Keim
3,858,623 A 1/1975 Lefkowitz
3,974,025 A 8/1976 Ayers
3,994,771 A 11/1976 Morgan, Jr. et al.
4,041,989 A 8/1977 Johansson et al.
4,071,050 A 1/1978 Codorniu
4,102,737 A 7/1978 Morton
4,112,982 A 9/1978 Bugge et al.
4,149,571 A 4/1979 Burroughs
4,157,276 A 6/1979 Wandel et al.
4,161,195 A 7/1979 Khan
4,182,381 A 1/1980 Gisbourne
4,184,519 A 1/1980 McDonald et al.
4,225,382 A 9/1980 Kearney et al.
4,239,065 A 12/1980 Trokhan
4,314,589 A 2/1982 Buchanan et al.
4,359,069 A 11/1982 Hahn
4,376,455 A 3/1983 Hahn
4,379,735 A 4/1983 MacBean
4,420,372 A 12/1983 Hostetler
4,440,597 A 4/1984 Wells et al.
4,448,638 A 5/1984 Klowak
4,453,573 A 6/1984 Thompson
4,482,429 A 11/1984 Klowak
4,490,925 A 1/1985 Smith
4,528,316 A 7/1985 Soerens
4,529,480 A 7/1985 Trokhan
4,543,156 A 9/1985 Cheshire et al.
4,551,199 A * 11/1985 Weldon ..... 162/111
4,564,052 A 1/1986 Borel
4,592,395 A 6/1986 Borel
4,603,176 A 7/1986 Bjorkquist et al.
4,605,585 A 8/1986 Johansson
4,605,702 A 8/1986 Guerro et al.
4,611,639 A 9/1986 Bugge
4,637,859 A 1/1987 Trokhan
4,640,741 A 2/1987 Tsuneo
4,675,394 A 6/1987 Solarek et al.
4,689,119 A 8/1987 Weldon
4,709,732 A 12/1987 Kinnunen
4,720,383 A 1/1988 Drach et al.
4,759,391 A 7/1988 Waldvogel et al.
4,759,976 A 7/1988 Dutt
4,804,769 A 2/1989 Solarek et al.
4,834,838 A 5/1989 Klowak
4,849,054 A 7/1989 Klowak
4,866,151 A 9/1989 Tsai et al.
4,942,077 A 7/1990 Wendt et al.
4,967,085 A 10/1990 Bryan et al.
4,981,557 A 1/1991 Bjorkquist
4,983,748 A 1/1991 Tsai et al.
4,998,568 A 3/1991 Vohringer
5,008,344 A 4/1991 Bjorkquist
5,016,678 A 5/1991 Borel et al.
5,054,525 A 10/1991 Vohringer
5,066,532 A 11/1991 Gaisser
5,085,736 A 2/1992 Bjorkquist
5,098,519 A 3/1992 Ramasubramanian et al.
5,103,874 A 4/1992 Lee
5,114,777 A 5/1992 Gaisser
5,138,002 A 8/1992 Bjorkquist
5,167,261 A 12/1992 Lee
5,199,261 A 4/1993 Baker
5,199,467 A 4/1993 Lee
5,211,815 A 5/1993 Ramasubramanian et al.
5,217,576 A 6/1993 Van Phan
5,219,004 A 6/1993 Chiu
5,223,096 A 6/1993 Phan et al.
5,240,562 A 8/1993 Phan et al.
5,245,025 A 9/1993 Trokhan et al.
5,262,007 A 11/1993 Phan et al.
5,264,082 A 11/1993 Phan et al.
5,277,761 A 1/1994 Van Phan et al.
5,312,522 A 5/1994 Van Phan et al.
5,314,584 A 5/1994 Grinnell et al.
5,328,565 A 7/1994 Rasch et al.
5,336,373 A 8/1994 Scattolino et al.
5,338,807 A 8/1994 Espy et al.
5,379,808 A 1/1995 Chiu
5,411,636 A 5/1995 Hermans et al.
5,415,737 A 5/1995 Phan et al.
5,449,026 A 9/1995 Lee
5,492,598 A 2/1996 Hermans et al.
5,505,818 A 4/1996 Hermans et al.
5,508,818 A 4/1996 Hamma
5,510,001 A 4/1996 Hermans et al.
5,510,002 A 4/1996 Hermans et al.
5,593,545 A 1/1997 Rugowski et al.
5,607,551 A 3/1997 Farrington, Jr. et al.
5,672,248 A 9/1997 Wendt et al.
5,690,149 A 11/1997 Lee
5,690,788 A 11/1997 Marinack et al.
5,851,353 A 12/1998 Fiscus et al.
5,961,782 A 10/1999 Luu et al.
6,017,417 A 1/2000 Wendt et al.
6,133,405 A 10/2000 Allen
6,187,137 B1 2/2001 Druecke et al.
6,207,011 B1 3/2001 Luu et al.
6,210,528 B1 * 4/2001 Wolkowicz ..... 162/111
6,287,426 B1 9/2001 Edwards et al.
6,350,349 B1 2/2002 Hermans et al.
6,432,267 B1 8/2002 Watson
6,447,640 B1 9/2002 Watson et al.
6,585,855 B2 7/2003 Drew et al.
6,607,638 B2 8/2003 Drew et al.
6,610,173 B1 8/2003 Lindsay et al.
7,399,378 B2 7/2008 Edwards et al.
7,416,637 B2 8/2008 Murray et al.
7,442,278 B2 * 10/2008 Murray et al. ..... 162/111
7,494,563 B2 2/2009 Edwards et al.
7,585,388 B2 9/2009 Yeh et al.
7,585,389 B2 9/2009 Yeh et al.
7,585,392 B2 9/2009 Kokko et al.
7,588,660 B2 9/2009 Edwards et al.
7,608,164 B2 10/2009 Chou et al.
7,662,257 B2 2/2010 Edwards et al.
7,695,128 B2 4/2010 Tombs et al.
7,718,036 B2 5/2010 Sumnicht et al.
7,789,995 B2 9/2010 Super et al.
7,850,823 B2 12/2010 Chou et al.
7,951,264 B2 5/2011 Sumnicht
7,959,761 B2 6/2011 Boettcher et al.
7,985,321 B2 7/2011 Sumnicht et al.
8,142,612 B2 * 3/2012 Murray et al. ..... 162/113
8,328,985 B2 12/2012 Edwards et al.
2002/0088577 A1 7/2002 Watson et al.
2003/0000664 A1 1/2003 Drew et al.
2004/0238135 A1 12/2004 Edwards et al.
2005/0217814 A1 10/2005 Super et al.
2005/0241786 A1 11/2005 Edwards et al.
2005/0241787 A1 11/2005 Murray et al.
2006/0000567 A1 1/2006 Murray et al.
2006/0237154 A1 10/2006 Edwards et al.
2006/0289133 A1 12/2006 Yeh et al.
2006/0289134 A1 12/2006 Yeh et al.
2007/0204966 A1 9/2007 Chou et al.
2007/0279471 A1 12/2007 Tombs et al.
2008/0029235 A1 2/2008 Edwards et al.
2008/0083519 A1 4/2008 Kokko et al.
2008/0173419 A1 7/2008 Sumnicht
2008/0264589 A1 10/2008 Chou et al.
2009/0020139 A1 1/2009 Sumnicht et al.
2009/0020248 A1 1/2009 Sumnicht et al.
2009/0126884 A1 5/2009 Murray et al.
2011/0218271 A1 9/2011 Boettcher et al.
2011/0265965 A1 11/2011 Sumnicht et al.
2012/0145341 A1 6/2012 Super et al.
2012/0145342 A1 6/2012 Edwards et al.

| | | | |
|---|---|---|---|
| 2012/0145343 | A1 | 6/2012 | Edwards et al. |
| 2012/0145344 | A1 | 6/2012 | Edwards et al. |
| 2012/0152474 | A1 | 6/2012 | Murray et al. |
| 2012/0152475 | A1 | 6/2012 | Edwards et al. |
| 2012/0160435 | A1 | 6/2012 | Edwards et al. |
| 2012/0164407 | A1 | 6/2012 | Edwards et al. |
| 2012/0180965 | A1 | 7/2012 | Super et al. |
| 2012/0180966 | A1 | 7/2012 | Super et al. |
| 2012/0180967 | A1 | 7/2012 | Edwards et al. |
| 2012/0211186 | A1 | 8/2012 | Murray et al. |

FOREIGN PATENT DOCUMENTS

| | | | |
|---|---|---|---|
| WO | 00/14330 | A1 | 3/2000 |
| WO | 01/85109 | A1 | 11/2001 |
| WO | 2005/103375 | A1 | 11/2005 |

OTHER PUBLICATIONS

Westfelt, Lars, "Chemistry of Paper Wet-Strength. I. A Survey of Mechanisms of Wet Strength Development," in Cellulose Chemistry and Technology, V. 13, pp. 813-825, 1979.

Evans, W. P., "Cationic fabric softeners," Chemistry and Industry, Jul. 5, 1969, pp. 893-903.

Egan, R. R., "Cationic Surface Active Agents as Fabric Softeners," J. Am. Oil Chemist's Soc., V. 55 (1978), pp. 118-121.

Trivedi, B. C., et al., "Quaternization of Imidazoline: Unequivocal Structure Proof," J. Am. Oil Chemist's Soc., Jun. 1981, pp. 754-756.

Parker, J. D., "Chapter 2 Practical Applications," in The Sheet Forming Process, STAP No. 9, 1972, pp. 63-93.

* cited by examiner

HIGH SOLIDS FABRIC CREPE PROCESS FOR PRODUCING ABSORBENT SHEET WITH IN-FABRIC DRYING

CLAIM FOR PRIORITY AND CROSS-REFERENCE TO RELATED APPLICATIONS

This application is a continuation application of U.S. patent application Ser. No. 12/321,448, filed on Jan. 21, 2009, which issued as U.S. Pat. No. 8,142,612 on Mar. 27, 2012, which is a divisional application of U.S. patent application Ser. No. 11/151,761, filed Jun. 14, 2005, now U.S. Pat. No. 7,503,998, which application claims the benefit of the filing date of U.S. Provisional Patent Application No. 60/580,847, of the same title, filed Jun. 18, 2004. The priority of U.S. patent application Ser. No. 11/151,761 and U.S. Provisional Patent Application No. 60/580,847 are hereby claimed, and the disclosures thereof are incorporated into this application by reference in their entireties.

TECHNICAL FIELD

The present invention relates generally to methods of making absorbent cellulosic sheet and, more particularly, to a method of making absorbent sheet by way of dewatering a cellulosic furnish and drying the nascent web without wet-pressing, followed by fabric creping the web, and further drying the web while it is held in the creping fabric. The method is readily adaptable to existing manufacturing assets including multiple can dryers, for example, of the type used to make coated papers. The process provides premium absorbent products with a minimum of capital investment and allows for the use of recycle fiber as well as recycle energy sources.

BACKGROUND

Methods of making paper tissue, towel, and the like, are well known, including various features such as Yankee drying, through-air drying (TAD), fabric creping, dry creping, wet creping, and so forth. Conventional wet pressing processes have certain advantages over conventional through-air drying processing including: (1) lower energy costs associated with the mechanical removal of water rather than transpiration drying with hot air, and (2) higher production speeds, which are more readily achieved with processes that utilize wet pressing to form a web. On the other hand, through-air drying processing has been widely adopted for new capital investment, particularly, for the production of soft, bulky, premium quality tissue and towel products.

Fabric creping has been employed in connection with papermaking processes that include mechanisms for compactive dewatering of the paper web as a means to influence product properties. See U.S. Pat. Nos. 4,689,119 and 4,551,199 to Weldon; U.S. Pat. Nos. 4,849,054 and 4,834,838 to Klowack; and No. 6,287,426 to Edwards et al. Operation of fabric creping processes has been hampered by the difficulty of effectively transferring a web of high or intermediate consistency to a dryer. Note also, U.S. Pat. No. 6,350,349 to Hermans et al., which discloses a wet transfer of a web from a rotating transfer surface to a fabric. Further United States Patents related to fabric creping more generally include the following: U.S. Pat. No. 4,834,838; No. 4,482,429, No. 4,448,638, as well as No. 4,440,597 to Wells et al.

In connection with the papermaking processing, fabric molding has also been employed as a means to provide texture and bulk. In this respect, U.S. Pat. No. 6,610,173 to Lindsey et al. discusses a method of imprinting a paper web during a wet pressing event that results in asymmetrical protrusions corresponding to the deflection conduits of a deflection member. The '173 patent reports that a differential velocity transfer during a pressing event serves to improve the molding and imprinting of a web with a deflection member. The tissue webs produced are reported as having particular sets of physical and geometrical properties, such as a pattern densified network and a repeating pattern of protrusions having asymmetrical structures. With respect to wet-molding of a web using textured fabrics, see, also, the following U.S. Pat. Nos. 6,017,417 and 5,672,248 both to Wendt et al.; U.S. Pat. Nos. 5,505,818 and 5,510,002 to Hermans et al. and No. 4,637,859 to Trokhan. With respect to the use of fabrics used to impart texture to a mostly dry sheet, see U.S. Pat. No. 6,585,855 to Drew et al., as well as United States Patent Application Publication No. 2003/0000664, now U.S. Pat. No. 6,607,638.

Through dried, creped products are disclosed in the following patents: U.S. Pat. No. 3,994,771 to Morgan, Jr. et al.; U.S. Pat. No. 4,102,737 to Morton; and U.S. Pat. No. 4,529,480 to Trokhan. The processes described in these patents comprise, very generally, forming a web on a foraminous support, thermally pre-drying the web, applying the web to a Yankee dryer with a nip defined, in part, by an impression fabric, and creping the product from the Yankee dryer. A relatively permeable web is typically required, making it difficult to employ recycle furnish at levels that may be desired. Transfer to the Yankee typically takes place at web consistencies of from about 60% to about 70%. See also, U.S. Pat. No. 6,187,137 to Druecke et al. As to the application of a vacuum while the web is in a fabric, the following are noted: U.S. Pat. No. 5,411,6363 to Hermans et al.; U.S. Pat. No. 5,492,598 to Hermans et al.; U.S. Pat. No. 5,505,819 to Hermans et al.; U.S. Pat. No. 5,510,001 to Hermans et al.; and U.S. Pat. No. 5,510,002 to Hermans et al.

U.S. Pat. No. 5,851,353 to Fiscus et al. teaches a method for can drying wet webs for tissue products, wherein a partially dewatered wet web is restrained between a pair of molding fabrics. The restrained wet web is processed over a plurality of can dryers, for example, from a consistency of about 40 percent to a consistency of at least about 70 percent. The sheet molding fabrics protect the web from direct contact with the can dryers and impart an impression on the web. See also U.S. Pat. No. 5,336,373 to Scattolino et al.

Despite numerous advances, through-dry processes tend to be expensive in terms of fixed costs and operating expense and remain relatively intolerant of recycle fiber. On the other hand, wet-pressed products tend to have lower absorbency and bulk.

In accordance with the present invention, the absorbency, bulk and stretch are improved by can drying, for example, prior to high solids fabric creping in a pressure nip and, thereafter, final drying the web. The process of the invention has the high speed and furnish tolerance to recycle fiber of conventional wet press processes, and is practiced without transferring a partially dried web to a Yankee dryer. A still further advantage of the invention is that the process can be practiced on existing flat paper machine assets modified to make premium tissue and towel basesheet.

SUMMARY OF THE INVENTION

In accordance with one aspect, the present invention provides a method of making a cellulosic web having elevated absorbency including (a) forming a nascent web having an apparently random distribution of fiber orientation from a papermaking furnish, (b) non-compactively drying the nascent web to a consistency of from about 30 to about 60 percent, (c) thereafter, transferring the web to a translating transfer surface moving at a first speed, (d) fabric-creping the web from the transfer surface at a consistency of from about 30 to about 60 percent utilizing a creping fabric, the creping step occurring under pressure in a fabric creping nip defined between the transfer surface and the creping fabric, wherein the fabric is traveling at a second speed that is slower than the speed of the transfer surface, the fabric pattern, nip parameters, velocity delta and web consistency being selected such that the web is creped from the transfer surface and redistributed on the creping fabric, (e) retaining the wet web in the creping fabric, (f) drying the wet web while it is held in the creping fabric to a consistency of at least about 90 percent, wherein the web has an absorbency of least about 5 g/g. Typically, the wet web is dried to a consistency of at least about 92 percent while it is held in the creping fabric and, preferably, the wet web is dried to a consistency of at least about 95 percent while it is held in the creping fabric.

In a preferred embodiment, the web is dried without wet-pressing with a first plurality of can dryers prior to being transferred to the translating transfer surface, while the web is held in a fabric. After creping, the web is further dried with a plurality of can dryers while it is held in the creping fabric, wherein, optionally, the web is dried with an impingement-air dryer.

The inventive method is advantageously operated at a Fabric Crepe of from about 10 to about 100 percent, preferably, in some cases, operated at a Fabric Crepe of at least about 40 percent. Fabric Crepe of at least about 60 percent or at least about 80 percent is readily achieved.

Among desirable properties of the products are cross machine direction (CD) stretch values of from about 5 percent to about 20 percent at low tensile ratios. One preferred product has a CD stretch of at least about 5 percent and a machine direction to cross machine direction MD/CD tensile ratio of less than about 1.75, while another has a CD stretch of at least about 5 percent and an MD/CD tensile ratio of less than about 1.5. Products with a CD stretch of at least about 10 percent and an MD/CD tensile ratio of less than about 2.5 may be prepared, likewise, products with a CD stretch of at least about 15 percent and MD/CD tensile ratio of less than about 3.0, or those with a CD stretch of at least about 20 percent and an MD/CD tensile ratio of less than about 3.5 may be prepared. Some products have an MD/CD tensile ratio of less than about 1.1, such as an MD/CD tensile ratio of from about 0.5 to about 0.9, or an MD/CD tensile ratio of from about 0.6 to about 0.8.

The inventive method may be practiced wherein the web is fabric-creped at a consistency of from about 45 percent to about 60 percent, or wherein the web is fabric-creped at a consistency of from about 40 percent to about 50 percent. In a preferred embodiment, fabric creping takes place at a consistency of at least about 35 percent.

Preferably, the web as an absorbency of at least about 7 g/g. More preferably, the web has an absorbency of at least about 9 g/g and, still more preferably, the web has an absorbency of at least about 11 g/g. Absorbencies of at least about 13 g/g and more are achieved.

In another aspect, the present invention provides a method of making a fabric-creped absorbent cellulosic sheet including (a) forming a nascent web having an apparently random distribution of fiber orientation from a papermaking furnish, (b) non-compactively drying the web to a consistency of from about 30 to about 60 percent, (c) thereafter, transferring the web to a translating transfer surface moving at a first speed, (d) fabric-creping the web from the transfer surface at a consistency of from about 30 to about 60 percent utilizing a creping fabric, the creping step occurring under pressure in a fabric creping nip defined between the transfer surface and the creping fabric, wherein the fabric is traveling at a second speed that is slower than the speed of the transfer surface, the fabric pattern, nip parameters, velocity delta and web consistency being selected such that the web is creped from the surface and redistributed on the creping fabric to form a web with a reticulum having a plurality of interconnected regions of different fiber orientation including at least (i) a plurality of fiber enriched regions of having an orientation bias in a direction transverse to the machine-direction, interconnected by way of (ii) a plurality of colligating regions whose fiber orientation bias is offset from the fiber orientation of the fiber enriched regions, (e) retaining the wet web in the creping fabric, and (f) drying the wet web while it is held in the creping fabric to a consistency of at least about 90 percent. Typically, the plurality of fiber enriched regions and colligating regions occur in a regular pattern of interconnected fibrous regions through the web, where the orientation bias of the fibers of the fiber enriched regions and colligating regions are transverse to one another, optionally, wherein the fibers of the fiber enriched regions are substantially oriented in the CD. In many preferred cases, the plurality of fiber enriched regions have a higher local basis weight than the colligating regions and at least a portion of the colligating regions consist of fibers that are substantially oriented in the MD, such as where there is a repeating pattern including a plurality of fiber enriched regions, a first plurality of colligating regions whose fiber orientation is biased toward the machine-direction, and a second plurality of colligating regions whose fiber orientation is biased toward the machine-direction, but offset from the fiber orientation bias of the first plurality of colligating regions. A preferred product is one wherein the fibers of at least one of the plurality of colligating regions are substantially oriented in the MD, and wherein the fiber enriched regions exhibit a plurality of U-shaped folds, as seen in FIGS. 13 and 15.

Typically, the creping fabric is provided with CD knuckles defining creping surfaces transverse to the machine-direction, such that the distribution of the fiber enriched regions in the product corresponds to the arrangement of CD knuckles on the creping fabric.

In yet another aspect, the present invention provides a method of making a fabric-creped absorbent cellulosic web including (a) forming a nascent web having an apparently random distribution of fiber orientation from a papermaking furnish, (b) non-compactively drying the web to a consistency of from about 30 to about 60 percent, (c) thereafter, transferring the web to a translating transfer surface moving at a first speed, (d) fabric-creping the web from the transfer surface at a consistency of from about 30 to about 60 percent utilizing a creping fabric, the creping step occurring under pressure in a fabric-creping nip defined between the transfer surface and the creping fabric, wherein the fabric is traveling at a second speed that is slower than the speed of the transfer surface, the fabric pattern, nip parameters, velocity delta and web consistency being selected such that the web is creped from the transfer surface and redistributed on the creping fabric to form a web with a reticulum having a plurality of interconnected regions of different local basis weights, including at least (i) a plurality of fiber enriched pileated regions of a high local basis weight, interconnected by way of (ii) a plurality of lower local basis weight linking regions whose fiber orientation is biased toward the direction between pileated regions, (e) retaining the wet web in the creping fabric, and (f) drying the wet web while it is held in the creping fabric to a consistency of at least about 90 percent.

In still yet another aspect, the invention provides a method of making a fabric-creped absorbent cellulosic sheet including (a) forming a nascent web having an apparently random distribution of fiber orientation from a papermaking furnish, (b) non-compactively drying the nascent web to a consistency of from about 30 to about 60 percent, (c) thereafter, transferring the web to a rotating surface of a transfer cylinder moving at a first speed, (d) fabric-creping the web from the transfer cylinder at a consistency of from about 30 to about 60 percent in a fabric creping nip defined between the transfer cylinder and a creping fabric traveling at a second speed that is slower than the transfer cylinder, wherein the web is creped from the cylinder and rearranged on the creping fabric, (e) retaining the wet web in the creping fabric, and (f) drying the wet web while it is held in the creping fabric to a consistency of at least about 90 percent and wherein the web has an absorbency of at least about 5 g/g, a CD stretch of at least about 4 percent, and an MD/CD tensile ratio of less than about 1.75. The partially dried web is optionally applied to the surface of the transfer cylinder with a polyvinyl alcohol containing adhesive.

A still further aspect includes a rush transfer before high solids fabric creping in a process that includes (a) forming a nascent web having an apparently random distribution of fiber orientation from a papermaking furnish, (b) rush-transferring the nascent web from a first fabric traveling at a first speed to a second fabric traveling at a second speed that is slower than the first speed, the rush transfer occurring while the web is at a consistency of from about 10 to about 30 percent, (c) non-compactively drying the nascent web to a consistency of from about 30 to about 60 percent, (d) thereafter, transferring the web to a translating transfer surface, (e) fabric-creping the web from the transfer surface at a consistency of from about 30 to about 60 percent utilizing a creping fabric, the creping step occurring under pressure in a fabric creping nip defined between the transfer surface and the creping fabric, wherein the creping fabric is traveling at a third speed that is slower than the speed of the transfer surface, the fabric pattern, nip parameters, velocity delta and web consistency being selected such that the web is creped from the transfer surface and redistributed on the creping fabric, (f) retaining the wet web in the creping fabric, and (g) drying the wet web while it is held in the creping fabric to a consistency of at least about 90 percent, wherein the web has an absorbency of at least about 5 g/g.

Still yet other features and advantages of the invention will become apparent from the following description and the appended Figures.

BRIEF DESCRIPTION OF THE DRAWINGS

The invention is described in detail below with reference to the drawings, wherein like numerals designate similar parts and wherein.

DETAILED DESCRIPTION

Figure 1:
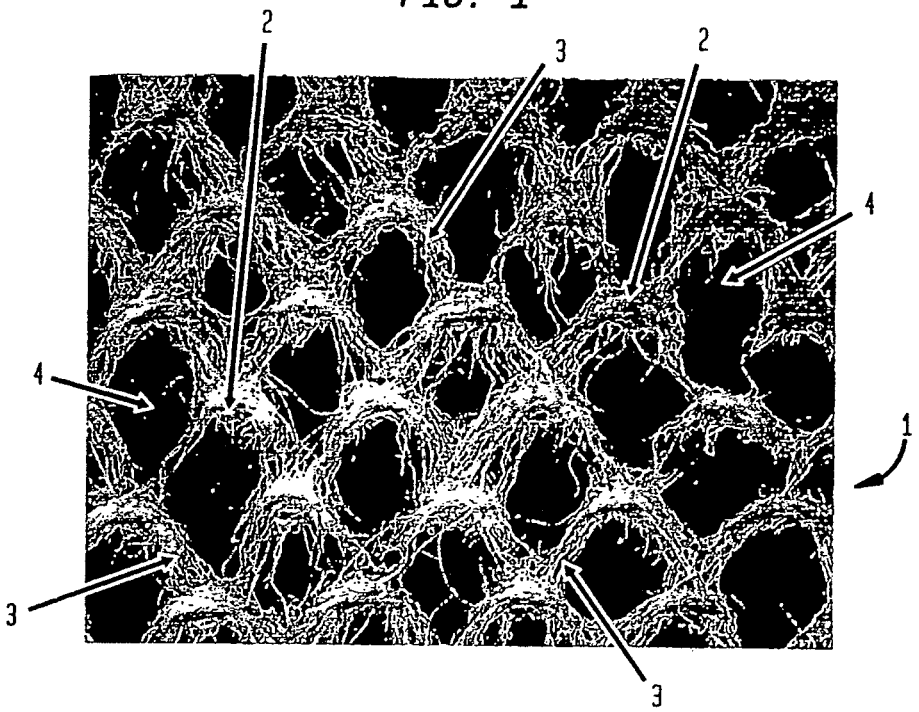
FIG. 1 is a photomicrograph (8×) of an open mesh web including a plurality of high basis weight regions linked by lower basis weight regions extending therebetween.

The invention is described below with reference to several embodiments. Such discussion is for purposes of illustration only. Modifications to particular examples within the spirit and scope of the present invention, set forth in the appended claims, will be readily apparent to one of skill in the art.

Terminology used herein is given its ordinary meaning consistent with the exemplary definitions set forth immediately below.

Throughout this specification and claims, when we refer to a nascent web having an apparently random distribution of fiber orientation (or use like terminology), we are referring to the distribution of fiber orientation that results when known forming techniques are used for depositing a furnish on the forming fabric. When examined microscopically, the fibers give the appearance of being randomly oriented, even though, depending on the jet to wire speed, there may be a significant bias toward a machine direction orientation making the machine direction tensile strength of the web exceed the cross machine direction tensile strength.

Unless otherwise specified, "basis weight", BWT, bwt, and so forth, refers to the weight of a 3000 square foot ream of product. Consistency refers to percent solids of a nascent web, for example, calculated on a bone dry basis. "Air dry" means including residual moisture, by convention, up to about 10 percent moisture for pulp and up to about 6% for paper. A nascent web having 50 percent water and 50 percent bone dry pulp has a consistency of about 50 percent.

The term "cellulosic", "cellulosic sheet", and the like, is meant to include any product incorporating papermaking fiber having cellulose as a major constituent. "Papermaking fibers" include virgin pulps or recycle (secondary) cellulosic fibers or fiber mixes comprising cellulosic fibers. Fibers suitable for making the webs of this invention include: nonwood fibers, such as cotton fibers or cotton derivatives, abaca, kenaf, sabai grass, flax, esparto grass, straw, jute, hemp, bagasse, milkweed floss fibers, and pineapple leaf fibers, and wood fibers such as those obtained from deciduous and coniferous trees, including softwood fibers, such as northern and southern softwood kraft fibers, hardwood fibers, such as eucalyptus, maple, birch, aspen, or the like. Papermaking fibers can be liberated from their source material by any one of a number of chemical pulping processes familiar to one experienced in the art including sulfate, sulfite, polysulfide, soda pulping, etc. The pulp can be bleached, if desired, by chemical means including the use of chlorine, chlorine dioxide, oxygen, alkaline peroxide, and so forth. The products of the present invention may comprise a blend of conventional fibers (whether derived from virgin pulp or recycle sources) and high coarseness lignin-rich tubular fibers, such as bleached chemical thermomechanical pulp (BCTMP). "Furnishes" and like terminology refers to aqueous compositions including papermaking fibers, optionally, wet strength resins, debonders, and the like, for making paper products.

As used herein, the term wet pressing the web or furnish refers to mechanical dewatering by wet pressing on a dewatering felt, for example, by use of mechanical pressure applied continuously over the web surface, as in a nip between a press roll and a press shoe, wherein the web is in contact with the papermaking felt. Wet pressing a nascent web thus refers, for example, to removing water from a nascent web having a consistency of less than 30 percent or so by application of pressure thereto and/or increasing the consistency of the web by about 15 percent or more by application of pressure thereto, while the wet web is in contact with a felt. The terminology "without wet pressing", "non-compactively dewatering", "non-compactively drying" and other like terminology means that the web is not compressed over its entire surface for purposes of pressing water out of the wet web. As opposed to wet pressing, the web is initially typically dewatered by can-drying in a dryer fabric. Localized compression or shaping by fabric knuckles does not substantially dewater the web and, accordingly, is not considered wet-pressing the web to remove water. The term "drying the nascent web" is thus thermal drying rather than compactive in nature.

Creping fabric and like terminology refers to a fabric or belt that bears a pattern suitable for practicing the process of the present invention and, preferably, is permeable enough such that the web may be dried while it is held in the creping fabric. In cases wherein the web is transferred to another fabric or surface (other than the creping fabric) for drying, the creping fabric may have a lower permeability.

"Fabric side" and like terminology refers to the side of the web that is in contact with the creping and drying fabric. "Dryer side" or "can side" is the side of the web opposite to the fabric side of the web.

Fpm refers to feet per minute.

MD means machine direction and CD means cross-machine direction.

Nip parameters include, without limitation, nip pressure, nip length, backing roll hardness, fabric approach angle, fabric takeaway angle, uniformity, and velocity delta between surface of the nip. Nip length means the length over which the nip surfaces are in contact.

A translating surface refers to the surface from which the web is creped into the creping fabric. The translating transfer surface may be the surface of a rotating drum as described hereafter, or may be the surface of a continuous smooth moving belt or another moving fabric that may have surface texture, and so forth. The translating transfer surface needs to support the web and facilitate the high solids creping, as will be appreciated from the discussion that follows.

Calipers and/or bulk reported herein may be measured, 1, 4 or 8 sheet calipers as specified. The sheets are stacked and the caliper measurement taken about the central portion of the stack. Preferably, the test samples are conditions in an atmosphere of 23E±1.0EC (73.4E±1.8EF) at 50% relative humidity for at least about 2 hours, and then, measured with a Thwing-Albert Model 89-II-JR or Progage Electronic Thickness Tester with 2-in (50.8-mm) diameter anvils, 539±10 grams dead weight load, and 0.231 in./sec. descent rate. For finished product testing, each sheet of product to be tested must have the same number of plies as the product that is sold. For testing, in general, eight sheets are selected and stacked together. For napkin testing, napkins are unfolded prior to stacking. For basesheet testing off of winders, each sheet to be tested must have the same number of plies as produced off of the winder. For basesheet testing off of the paper machine reel, single plies must be used. Sheets are stacked together aligned in the MD. On custom embossed or printed product, try to avoid taking measurements in these areas if at all possible. Bulk may also be expressed in units of volume/weight by dividing caliper by basis weight.

Absorbency of the inventive products is measured with a simple absorbency tester. The absorbency tester is a particularly useful apparatus for measuring the hydrophilicity and absorbency properties of a sample of tissue, napkins, or towel. In this test, a sample of tissue, napkins, or towel 2.0 inches in diameter is mounted between a top flat plastic cover and a bottom grooved sample plate. The tissue, napkin, or towel sample disc is held in place by a ⅛ inch wide circumference flange area. The sample is not compressed by the holder. De-ionized water at 73EF is introduced to the sample at the center of the bottom sample plate through a 1 mm. diameter conduit. This water is at a hydrostatic head of minus 5 mm. Flow is initiated by a pulse introduced at the start of the measurement by the instrument mechanism. Water is thus imbibed by the tissue, napkin, or towel sample from this central entrance point radially outward by capillary action. When the rate of water imbibition decreases below 0.005 gm water per 5 seconds, the test is terminated. The amount of water removed from the reservoir and absorbed by the sample is weighed and reported as grams of water per square meter of sample, or grams of water per gram of sheet. In practice, an M/K Systems Inc. Gravimetric Absorbency Testing System is used. This is a commercial system obtainable from M/K Systems Inc., 12 Garden Street, Danvers, Mass., 01923. WAC or water absorbent capacity, also referred to as SAT, is actually determined by the instrument itself. WAC is defined as the point where the weight versus time graph has a "zero" slope, i.e., the sample has stopped absorbing. The termination criteria for a test are expressed in maximum change in water weight absorbed over a fixed time period. This is basically an estimate of zero slope on the weight versus time graph. The program uses a change of 0.005 g over a 5 second time interval as termination criteria, unless "Slow SAT" is specified, in which case, the cut off criteria is 1 mg in 20 seconds.

Dry tensile strengths (MD and CD), stretch, ratios thereof, modulus, break modulus, stress and strain are measured with a standard Instron test device or other suitable elongation tensile tester that may be configured in various ways, typically, using 3 or 1 inch wide strips of tissue or towel, conditioned in an atmosphere of 23E±1.0EC (73.4E±1.8EF) at 50% relative humidity for 2 hours. The tensile test is run at a crosshead speed of 2 in/min. Modulus is expressed in lbs/inch per inch of elongation unless otherwise indicated.

Tensile ratios are simply ratios of the values determined by way of the foregoing methods. Unless otherwise specified, a tensile property is a dry sheet property.

"Fabric crepe ratio" is an expression of the speed differential between the creping fabric and the forming wire, and is typically calculated as the ratio of the web speed immediately before fabric creping and the web speed immediately following fabric creping, the forming wire and transfer surface being typically, but not necessarily, operated at the same speed:

Fabric crepe ratio=transfer cylinder speed)creping fabric speed.

Fabric crepe can also be expressed as a percentage calculated as:

Fabric crepe, percent,=[Fabric crepe ratio−1]*H* 100%.

A web creped from a transfer cylinder with a surface speed of 750 fpm to a fabric with a velocity of 500 fpm has a fabric crepe ratio of 1.5 and a fabric crepe of 50%.

Likewise:

Rush Transfer Ratio=donor fabric speed)receiving fabric speed.

Rush Transfer, percent=(Rush Transfer Ratio−1)*H* 100%.

PLI or pli means pounds of force per linear inch.

Pusey and Jones (P&J) hardness (indentation) is measured in accordance with ASTM D 531, and refers to the indentation number (standard specimen and conditions).

Velocity delta means a difference in linear speed.

During fabric creping in a pressure nip, the fiber is redistributed on the fabric, making the process tolerant of less than ideal forming conditions, as are sometimes seen with a Fourdrinier former. The forming section of a Fourdrinier machine includes two major parts, the headbox and the Fourdrinier Table. The latter consists of the wire run over the various drainage-controlling devices. The actual forming occurs along the Fourdrinier Table. The hydrodynamic effects of drainage, oriented shear, and turbulence generated along the table are generally the controlling factors in the forming process. Of course, the headbox also has an important influence in the process, usually, on a scale that is much larger than the structural elements of the paper web. Thus, the headbox may cause such large-scale effects as variations in distribution of flow rates, velocities, and concentrations across the full width of the machine, vortex streaks generated ahead of and aligned in the machine direction by the accelerating flow in the approach to the slice, and time-varying surges or pulsations of flow to the headbox. The existence of MD-aligned vortices in headbox discharges is common. Fourdrinier formers are further described in *The Sheet Forming Process*, Parker, J. D., Ed., TAPPI Press (1972, reissued 1994) Atlanta, Ga.

A creping adhesive is optionally used to secure the web to the transfer cylinder described hereafter. The adhesive is preferably a hygroscopic, re-wettable, substantially non-crosslinking adhesive. Examples of preferred adhesives are those that include poly(vinyl alcohol) of the general class described in U.S. Pat. No. 4,528,316 to Soerens et al. Other suitable adhesives are disclosed in U.S. Provisional Patent Application No. 60/372,255, filed Apr. 12, 2002, entitled "Improved Creping Adhesive Modifier and Process for Producing Paper Products", which was converted into two applications, one of which is now U.S. Pat. No. 7,959,761 and one of which has been published as U.S. Patent Application Publication No. 2011/0218271. The disclosures of the '316 patent the '255 application, the '761 patent and the '271 publication are incorporated herein by reference. Suitable adhesives are optionally provided with modifiers and so forth.

It is preferred to use crosslinker sparingly, or not at all, in the adhesive in many cases, such that the resin is substantially non-crosslinkable in use.

Creping adhesives may comprise a thermosetting or non-thermosetting resin, a film-forming semi-crystalline polymer and, optionally, an inorganic cross-linking agent, as well as modifiers. Optionally, the creping adhesive of the present invention may also include an art-recognized component, including, but not limited to, organic cross linkers, hydrocarbons oils, surfactants, or plasticizers.

Creping modifiers that may be used include a quaternary ammonium complex comprising at least one non-cyclic amide. The quaternary ammonium complex may also contain one or several nitrogen atoms (or other atoms) that are capable of reacting with alkylating or quaternizing agents. These alkylating or quaternizing agents may contain zero, one, two, three or four non-cyclic amide containing groups. An amide containing group is represented by the following formula structure:

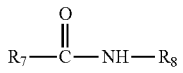

where $R_7$ and $R_8$ are non-cyclic molecular chains of organic or inorganic atoms.

Preferred non-cyclic bis-amide quaternary ammonium complexes can be of the formula:

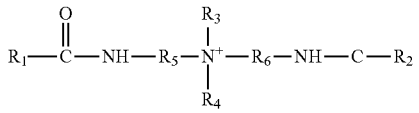

where $R_1$ and $R_2$ can be long chain non-cyclic saturated or unsaturated aliphatic groups, $R_3$ and $R_4$ can be long chain non-cyclic saturated or unsaturated aliphatic groups, a halogen, a hydroxide, an alkoxylated fatty acid, an alkoxylated fatty alcohol, a polyethylene oxide group, or an organic alcohol group, and $R_5$ and $R_6$ can be long chain non-cyclic saturated or unsaturated aliphatic groups. The modifier is present in the creping adhesive in an amount of from about 0.05% to about 50%, more preferably, from about 0.25% to about 20%, and, most preferably, from about 1% to about 18% based on the total solids of the creping adhesive composition.

Modifiers include those obtainable from Goldschmidt Corporation of Essen/Germany or Process Application Corporation based in Washington Crossing, Pa. Appropriate creping modifiers from Goldschmidt Corporation include, but are not limited to, VARISOFT® 222LM, VARISOFT® 222, VARISOFT® 110, VARISOFT® 222LT, VARISOFT® 110 DEG, and VARISOFT® 238. Appropriate creping modifiers from Process Application Corporation include, but are not limited to, PALSOFT 580 FDA or PALSOFT 580C.

Other creping modifiers for use in the present invention include, but are not limited to, those compounds as described in Published International Patent Application WO 2001/85109, which is incorporated herein by reference in its entirety.

Creping adhesives for use in connection with the present invention may include any suitable thermosetting or non-thermosetting resin. Resins according to the present invention are preferably chosen from the thermosetting and non-thermosetting polyamide resins or glyoxylated polyacrylamide resins. Polyamides for use in the present invention can be branched or unbranched, saturated or unsaturated.

Polyamide resins for use in the present invention may include polyaminoamide-epichlorohydrin (PAE) resins of the same general type employed as wet strength resins. PAE resins are described, for example, in "Wet Strength Resins and Their Application," Ch. 2, H. Espy, entitled Alkaline-Curing Polymeric Amine-Epicholohydrin Resins, which is incorporated herein by reference in its entirety. Preferred PAE resins for use according to the present invention include a water-soluble polymeric reaction product of an epihalohydrin, preferably, epichlorohydrin, and a water-soluble polyamide having secondary amine groups derived from a polyalkylene polyamine and a saturated aliphatic dibasic carboxylic acid containing from about 3 to about 10 carbon atoms.

A non-exhaustive list of non-thermosetting cationic polyamide resins can be found in U.S. Pat. No. 5,338,807, issued to Espy et al. and incorporated herein by reference. The non-thermosetting resin may be synthesized by directly reacting the polyamides of a dicarboxylic acid and methyl bis(3-aminopropyl)amine in an aqueous solution, with epichlorohydrin. The carboxylic acids can include saturated and unsaturated dicarboxylic acids having from about 2 to 12 carbon atoms, including, for example, oxalic, malonic, succinic, glutaric, adipic, pilemic, suberic, azelaic, sebacic, maleic, itaconic, phthalic, and terephthalic acids. Adipic and glutaric acids are preferred, with adipic acid being the most preferred. The esters of the aliphatic dicarboxylic acids and aromatic dicarboxylic acids, such as the phthalic acid, may be used, as well as combinations of such dicarboxylic acids or esters.

Thermosetting polyamide resins for use in the present invention may be made from the reaction product of an epihalohydrin resin and a polyamide containing secondary amine or tertiary amines. In the preparation of such a resin, a dibasic carboxylic acid is first reacted with the polyalkylene polyamine, optionally, in an aqueous solution, under conditions suitable to produce a water-soluble polyamide. The preparation of the resin is completed by reacting the water-soluble amide with an epihalohydrin, particularly, epichlorohydrin, to form the water-soluble thermosetting resin.

The preparation of water soluble, thermosetting polyamide-epihalohydrin resin is described in U.S. Pat. Nos. 2,926,116; 3,058,873; and 3,772,076 issued to Kiem, all of which are incorporated herein by reference in their entirety.

The polyamide resin may be based on DETA, instead of a generalized polyamine. Two examples of structures of such a polyamide resin are given below. Structure 1 shows two types of end groups: a di-acid and a mono-acid based group.

STRUCTURE 1

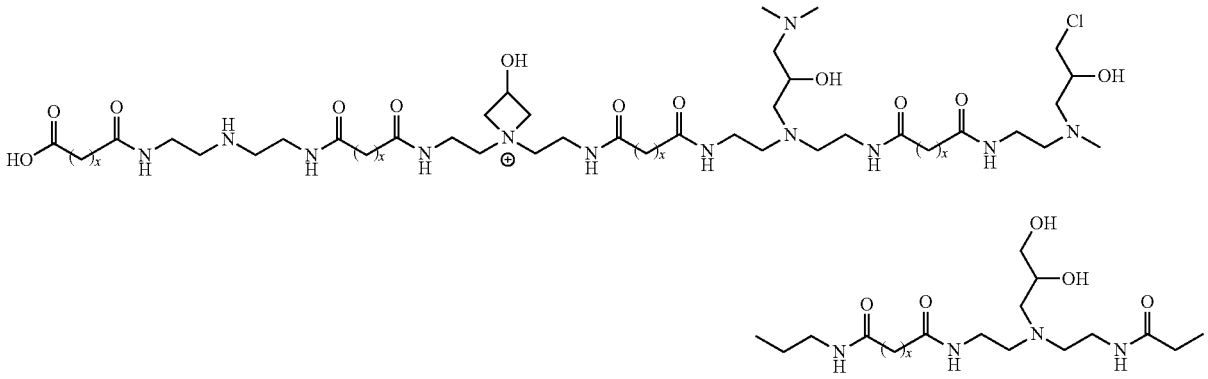

Structure 2 shows a polymer with one end-group based on a di-acid group and the other end-group based on a nitrogen group.

STRUCTURE 2

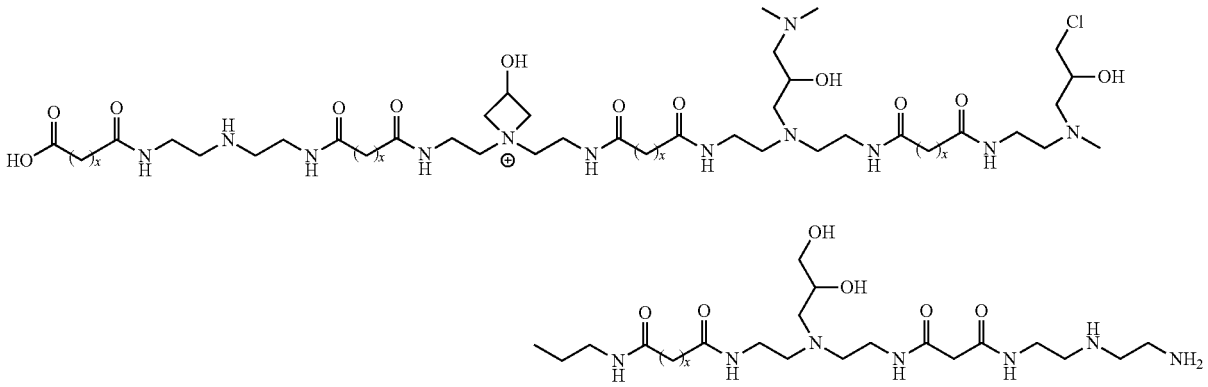

Note that although both structures are based on DETA, other polyamides may be used to form this polymer, including those, which may have tertiary amide side chains.

The polyamide resin has a viscosity of from about 80 to about 800 centipoise and a total solids of from about 5% to about 40%. The polyamide resin is present in the creping adhesive according to the present invention in an amount of from about 0% to about 99.5%. According to another embodiment, the polyamide resin is present in the creping adhesive in an amount of from about 20% to about 80%. In yet another embodiment, the polyamide resin is present in the creping adhesive in an amount of from about 40% to about 60%, based on the total solids of the creping adhesive composition.

Polyamide resins for use according to the present invention can be obtained from Ondeo-Nalco Corporation, based in Naperville, Ill., and Hercules Corporation, based in Wilmington, Del. Creping adhesive resins for use according to the present invention from Ondeo-Nalco Corporation include, but are not limited to, CREPECCEL® 675NT, CREPECCEL® 675P and CREPECCEL® 690HA. Appropriate creping adhesive resins available from Hercules Corporation include, but are not limited to, HERCULES 82-176, Unisoft 805 and CREPETROL A-6115.

Other polyamide resins for use according to the present invention include, for example, those described in U.S. Pat. Nos. 5,961,782 and 6,133,405, both of which are incorporated herein by reference.

The creping adhesive may also comprise a film-forming semi-crystalline polymer. Film-forming semi-crystalline polymers for use in the present invention can be selected from, for example, hemicellulose, carboxylmethyl cellulose, and, most preferably, includes polyvinyl alcohol (PVOH). Polyvinyl alcohols used in the creping adhesive can have an average molecular weight of about 13,000 to about 124,000 daltons. According to one embodiment, the polyvinyl alcohols have a degree of hydrolysis of from about 80% to about 99.9%. According to another, embodiment, polyvinyl alcohols have a degree of hydrolysis of from about 85% to about 95%. In yet another embodiment, polyvinyl alcohols have degrees of hydrolysis of from about 85% to about 90%. Also, according to one embodiment, polyvinyl alcohols preferably have a viscosity, measured at 20 degree centigrade using a 4% aqueous solution, of from about 2 to about 100 centipoise. According to another embodiment, polyvinyl alcohols have a viscosity of from about 10 to about 70 centipoise. In yet another embodiment, polyvinyl alcohols have a viscosity of from about 20 to about 50 centipoise.

Typically, the polyvinyl alcohol is present in the creping adhesive in an amount of from about 10% to about 90% or 20% to about 80% or more. In some embodiments, the polyvinyl alcohol is present in the creping adhesive in an amount of from about 40% to about 60%, by weight, based on the total solids of the creping adhesive composition.

Polyvinyl alcohols for use according to the present invention include those obtainable from Monsanto Chemical Co. and Celanese Chemical. Appropriate polyvinyl alcohols from Monsanto Chemical Co. include Gelvatols, including, but not limited to, GELVATOL 1-90, GELVATOL 3-60, GELVATOL 20-30, GELVATOL 1-30, GELVATOL 20-90, and GELVATOL 20-60. Regarding the Gelvatols, the first number indicates the percentage of residual polyvinyl acetate and the next series of digits when multiplied by 1,000 gives the number corresponding to the average molecular weight.

Celanese Chemical polyvinyl alcohol products for use in the creping adhesive (previously named Airvol products from Air Products until October 2000) are listed below:

TABLE 1

Polyvinyl Alcohol for Creping Adhesive

| Grade | % Hydrolysis, | Viscosity, eps[1] | pH | Volatiles, % Max | Ash, % Max |
|---|---|---|---|---|---|
| Super Hydrolyzed | | | | | |
| Celvol 125 | 99.3+ | 28-32 | 5.5-7.5 | 5 | 1.2 |
| Celvol 165 | 99.3+ | 62-72 | 5.5-7.5 | 5 | 1.2 |
| Fully Hydrolyzed | | | | | |
| Celvol 103 | 98.0-98.8 | 3.5-4.5 | 5.0-7.0 | 5 | 1.2 |
| Celvol 305 | 98.0-98.8 | 4.5-5.5 | 5.0-7.0 | 5 | 1.2 |
| Celvol 107 | 98.0-98.8 | 5.5-6.6 | 5.0-7.0 | 5 | 1.2 |
| Celvol 310 | 98.0-98.8 | 9.0-11.0 | 5.0-7.0 | 5 | 1.2 |
| Celvol 325 | 98.0-98.8 | 28.0-32.0 | 5.0-7.0 | 5 | 1.2 |
| Celvol 350 | 98.0-98.8 | 62-72 | 5.0-7.0 | 5 | 1.2 |
| Intermediate Hydrolyzed | | | | | |
| Celvol 418 | 91.0-93.0 | 14.5-19.5 | 4.5-7.0 | 5 | 0.9 |
| Celvol 425 | 95.5-96.5 | 27-31 | 4.5-6.5 | 5 | 0.9 |
| Partially Hydrolyzed | | | | | |
| Celvol 502 | 87.0-89.0 | 3.0-3.7 | 4.5-6.5 | 5 | 0.9 |
| Celvol 203 | 87.0-89.0 | 3.5-4.5 | 4.5-6.5 | 5 | 0.9 |
| Celvol 205 | 87.0-89.0 | 5.2-6.2 | 4.5-6.5 | 5 | 0.7 |
| Celvol 513 | 86.0-89.0 | 13-15 | 4.5-6.5 | 5 | 0.7 |
| Celvol 523 | 87.0-89.0 | 23-27 | 4.0-6.0 | 5 | 0.5 |
| Celvol 540 | 87.0-89.0 | 45-55 | 4.0-6.0 | 5 | 0.5 |

[1]4% aqueous solution, 20EC

The creping adhesive may also comprise one or more organic cross-linking salts or agents. Such adhesives are believed best used sparingly or not at all in connection with the present invention. A non-exhaustive list of multivalent metal ions includes calcium, barium, titanium, chromium, manganese, iron, cobalt, nickel, zinc, molybdenum, tin, antimony, niobium, vanadium, tungsten, selenium, and zirconium. Mixtures of metal ions can be used. Preferred anions include acetate, formate, hydroxide, carbonate, chloride, bromide, iodide, sulfate, tartrate, and phosphate. An example of a preferred inorganic cross-linking salt is a zirconium salt. The zirconium salt for use according to one embodiment of the present invention can be chosen from one or more zirconium compounds having a valence of plus four, such as ammonium zirconium carbonate, zirconium acetylacetonate, zirconium, acetate, zirconium carbonate, zirconium sulfate, zirconium phosphate, potassium zirconium carbonate, zirconium sodium phosphate, and sodium zirconium tartrate. Appropriate zirconium compounds include, for example, those described in U.S. Pat. No. 6,207,011, which is incorporated herein by reference.

The inorganic cross-linking salt can be present in the creping adhesive in an amount of from about 0% to about 30%. In another embodiment, the inorganic cross-linking agent can be present in the creping adhesive in an amount of from about 1% to about 20%. In yet another embodiment, the inorganic cross-linking salt can be present in the creping adhesive in an amount of from about 1% to about 10% by weight based on the total solids of the creping adhesive composition. Zirconium compounds for use according to the present invention include those obtainable from EKA Chemicals Co. (previously, Hopton Industries) and Magnesium Elektron, Inc. Appropriate commercial zirconium compounds from EKA Chemicals Co. are AZCOTE 5800M and KZCOTE 5000 and from Magnesium Elektron, Inc. are AZC or KZC.

Optionally, the creping adhesive according to the present invention can include any other art recognized components, including, but not limited to, organic cross-linkers, hydrocarbon oils, surfactants, amphoterics, humectants, plasticizers, or other surface treatment agents. An extensive, but non-exhaustive, list of organic cross-linkers includes glyoxal, maleic anhydride, bismaleimide, bis acrylamide, and epihalohydrin. The organic cross-linkers can be cyclic or non-cyclic compounds. Plasticizers for use in the present invention can include propylene glycol, diethylene glycol, triethylene glycol, dipropylene glycol, and glycerol.

The creping adhesive may be applied as a single composition or may be applied in its component parts. More particularly, the polyamide resin may be applied separately from the polyvinyl alcohol (PVOH) and the modifier.

According to the present invention, an absorbent paper web is made by dispersing papermaking fibers into aqueous furnish (slurry) and depositing the aqueous furnish onto the forming wire of a papermaking machine. Any suitable forming scheme might be used. For example, an extensive, but non-exhaustive, list in addition to Fourdrinier formers includes a crescent former, a C-wrap twin wire former, an S-wrap twin wire former, or a suction breast roll former. The forming fabric can be any suitable foraminous member including single layer fabrics, double layer fabrics, triple layer fabrics, photopolymer fabrics, and the like. Non-exhaustive background art in the forming fabric area includes U.S. Pat. Nos. 4,157,276; 4,605,585; 4,161,195; 3,545,705; 3,549,742, 3,858,623; 4,041,989; 4,071,050; 4,112,982; 4,149,571; 4,182,381; 4,184,519; 4,314,589; 4,359,069; 4,376,455; 4,379,735; 4,453,573; 4,564,052; 4,592,395; 4,611,639; 4,640,741; 4,709,732; 4,759,391; 4,759,976; 4,942,077; 4,967,085; 4,998,568; 5,016,678; 5,054,525; 5,066,532; 5,098,519; 5,103,874;5,114,777; 5,167,261; 5,199,261; 5,199,467; 5,211,815; 5,219,004; 5,245,025; 5,277,761; 5,328,565; and 5,379,808, all of which are incorporated herein by reference in their entirety. One forming fabric particularly useful with the present invention is Voith Fabrics Forming Fabric 2164 made by Voith Fabrics Corporation, Shreveport, La.

Foam-forming of the aqueous furnish on a forming wire or fabric may be employed as a means for controlling the permeability or void volume of the sheet upon fabric-creping. Foam-forming techniques are disclosed in U.S. Pat. No. 4,543,156 and Canadian Patent No. 2,053,505, the disclosures of which are incorporated herein by reference. The foamed fiber furnish is made up from an aqueous slurry of fibers mixed with a foamed liquid carrier just prior to its introduction to the headbox. The pulp slurry supplied to the system has a consistency in the range of from about 0.5 to about 7 weight percent fibers, preferably, in the range of from about 2.5 to about 4.5 weight percent. The pulp slurry is added to a foamed liquid comprising water, air and surfactant containing 50 to 80 percent air by volume forming a foamed fiber furnish having a consistency in the range of from about 0.1 to about 3 weight percent fiber, by simple mixing from natural turbulence and mixing inherent in the process elements. The addition of the pulp as a low consistency slurry results in excess foamed liquid recovered from the forming wires. The excess foamed liquid is discharged from the system and may be used elsewhere or treated for recovery of surfactant therefrom.

The furnish may contain chemical additives to alter the physical properties of the paper produced. These chemistries are well understood by the skilled artisan and may be used in any known combination. Such additives may be surface modifiers, softeners, debonders, strength aids, latexes, opacifiers, optical brighteners, dyes, pigments, sizing agents, barrier chemicals, retention aids, insolubilizers, organic or inorganic crosslinkers, or combinations thereof, the chemicals optionally comprising polyols, starches, PPG esters, PEG esters, phospholipids, surfactants, polyamines, HMCP (Hydrophobically Modified Cationic Polymers), HMAP (Hydrophobically Modified Anionic Polymers), or the like.

The pulp can be mixed with strength adjusting agents such as wet strength agents, dry strength agents and debonders/softeners, and so forth. Suitable wet strength agents are known to the skilled artisan. A comprehensive, but non-exhaustive, list of useful strength aids include urea-formaldehyde resins, melamine formaldehyde resins, glyoxylated polyacrylamide resins, polyamide-epichlorohydrin resins, and the like. Thermosetting polyacrylamides are produced by reacting acrylamide with diallyl dimethyl ammonium chloride (DADMAC) to produce a cationic polyacrylamide copolymer that is ultimately reacted with glyoxal to produce a cationic cross-linking wet strength resin, glyoxylated polyacrylamide. These materials are generally described in U.S. Pat. Nos. 3,556,932 to Coscia et al. and 3,556,933 to Williams et al., both of which are incorporated herein by reference in their entirety. Resins of this type are commercially available under the trade name of PAREZ 631NC by Bayer Corporation. Different mole ratios of acrylamide/-DADMAC/glyoxal can be used to produce cross-linking resins, which are useful as wet strength agents. Furthermore, other dialdehydes can be substituted for glyoxal to produce thermosetting wet strength characteristics. Of particular utility are the polyamide-epichlorohydrin wet strength resins, an example of which is sold under the trade names Kymene 557LX and Kymene 557H by Hercules Incorporated of Wilmington, Del. and Amres® from Georgia-Pacific Resins, Inc. These resins and the process for making the resins are described in U.S. Pat. No. 3,700,623 and U.S. Pat. No. 3,772,076, each of which is incorporated herein by reference in its entirety. An extensive description of polymeric-epihalohydrin resins is given in Chapter 2*: Alkaline-Curing Polymeric Amine-Epichlorohydrin* by Espy in *Wet Strength Resins and Their Application* (L. Chan, Editor, 1994), incorporated by reference herein in its entirety. A reasonably comprehensive list of wet strength resins is described by Westfelt in *Cellulose Chemistry and Technology*, Volume 13, p. 813, 1979, which is incorporated herein by reference.

Suitable temporary wet strength agent may likewise be included. A comprehensive, but non-exhaustive, list of useful temporary wet strength agents includes aliphatic and aromatic aldehydes including glyoxal, malonic dialdehyde, succinic dialdehyde, glutaraldehyde and dialdehyde starches, as well as substituted or reacted starches, disaccharides, polysaccharides, chitosan or other reacted polymeric reaction products of monomers or polymers having aldehyde groups, and, optically, nitrogen groups. Representative nitrogen containing polymers, which can suitably be reacted with the aldehyde containing monomers or polymers, include vinylamides, acrylamides and related nitrogen containing polymers. These polymers impart a positive charge to the aldehyde containing reaction product. In addition, other commercially available temporary wet strength agents, such as, PAREZ 745, manufactured by Bayer can be used, along with those disclosed, for example, in U.S. Pat. No. 4,605,702.

The temporary wet strength resin may be any one of a variety of water-soluble organic polymers comprising aldehydic units and cationic units used to increase dry and wet tensile strength of a paper product. Such resins are described in U.S. Pat. Nos. 4,675,394; 5,240,562; 5,138,002; 5,085,736; 4,981,557; 5,008,344; 4,603,176; 4,983,748; 4,866,151; 4,804,769 and 5,217,576. Modified starches sold under the trademarks CO-BOND® 1000 and CO-BOND® 1000 Plus, by National Starch and Chemical Company of Bridgewater, N.J. may be used. Prior to use, the cationic aldehydic water soluble polymer can be prepared by preheating an aqueous slurry of approximately 5% solids maintained at a temperature of approximately 240 degrees Fahrenheit and a pH of about 2.7 for approximately 3.5 minutes. Finally, the slurry can be quenched and diluted by adding water to produce a mixture of approximately 1.0% solids at less than about 130 degrees Fahrenheit.

Other temporary wet strength agents, also available from National Starch and Chemical Company are sold under the trademarks CO-BONDS 1600 and CO—BONDS 2300. These starches are supplied as aqueous colloidal dispersions and do not require preheating prior to use.

Temporary wet strength agents, such as glyoxylated polyacrylamide, can be used. Temporary wet strength agents, such as glyoxylated polyacrylamide resins, are produced by reacting acrylamide with diallyl dimethyl ammonium chloride (DADMAC) to produce a cationic polyacrylamide copolymer that is ultimately reacted with glyoxal to produce a cationic cross-linking temporary or semi-permanent wet strength resin, glyoxylated polyacrylamide. These materials are generally described in U.S. Pat. No. 3,556,932 to Coscia et al. and U.S. Pat. No. 3,556,933 to Williams et al., both of which are incorporated herein by reference. Resins of this type are commercially available under the trade name of PAREZ 631NC, by Bayer Industries. Different mole ratios of acrylamide/DADMAC/glyoxal can be used to produce cross-linking resins, which are useful wet strength agents. Furthermore, other dialdehydes can be substituted for glyoxal to produce wet strength characteristics.

Suitable dry strength agents include starch, guar gum, polyacrylamides, carboxylmethyl cellulose, and the like. Of particular utility is carboxymethyl cellulose, an example of which is sold under the trade name Hercules CMC, by Hercules Incorporated of Wilmington, Del. According to one embodiment, the pulp may contain from about 0 to about 15 lb/ton of dry strength agent. According to another embodiment, the pulp may contain from about 1 to about 5 lbs/ton of dry strength agent.

Suitable debonders are likewise known to the skilled artisan. Debonders or softeners may also be incorporated into the pulp or sprayed upon the web after its formation. The present invention may also be used with softener materials including, but not limited to, the class of amido amine salts derived from partially acid neutralized amines. Such materials are disclosed in U.S. Pat. No. 4,720,383. Evans, *Chemistry and Industry,* 5 Jul. 1961, pp. 893-903; Egan, *J. Am. Oil Chemist's Soc.*, Vol. 55 (1978), pp. 118-121; and Trivedi et al., *J. Am. Oil Chemist's Soc.*, June 1981, pp. 754-756, incorporated by reference in their entirety, indicate that softeners are often available commercially only as complex mixtures rather than as single compounds. While the following discussion will focus on the predominant species, it should be understood that commercially available mixture would generally be used in practice.

Quasoft 202-JR is a suitable softener material, which may be derived by alkylating a condensation product of oleic acid and diethylenetriamine. Synthesis conditions using a deficiency of alkylation agent (e.g., diethyl sulfate) and only one alkylating step, following by a pH adjustment to protonate the non-ethylated species, result in a mixture consisting of cationic ethylated and cationic non-ethylated species. A minor proportion (e.g., about 10%) of the resulting amido amine cyclize to imidazoline compounds. Since only the imidazoline portions of these materials are quaternary ammonium compounds, the compositions as a whole are pH-sensitive. Therefore, in the practice of the present invention with this class of chemicals, the pH in the head box should be approximately 6 to 8, more preferably, 6 to 7 and, most preferably, 6.5 to 7.

Quaternary ammonium compounds, such as dialkyl dimethyl quaternary ammonium salts are also suitable, particularly, when the alkyl groups contain from about 10 to 24 carbon atoms. These compounds have the advantage of being relatively insensitive to pH.

Biodegradable softeners can be utilized. Representative biodegradable cationic softeners/debonders are disclosed in U.S. Pat. Nos. 5,312,522; 5,415,737; 5,262,007; 5,264,082; and 5,223,096, all of which are incorporated herein by reference in their entirety. The compounds are biodegradable diesters of quaternary ammonia compounds, quaternized amine-esters, and biodegradable vegetable oil based esters functional with quaternary ammonium chloride and diester dierucyldimethyl ammonium chloride and are representative biodegradable softeners.

In some embodiments, a particularly preferred debonder composition includes a quaternary amine component, as well as a nonionic surfactant.

Suitable creping fabric includes single layer, multi-layer, or composite, preferably, open meshed structures. Fabrics may have at least one of the following characteristics: (1) on the side of the creping fabric that is in contact with the wet web (the "top" side), the number of machine direction (MD) strands per inch (mesh) is from 10 to 200 and the number of cross-direction (CD) strands per inch (count) is also from to 10 to 200, (2) the strand diameter is typically smaller than 0.050 inch, (3) on the top side, the distance between the highest point of the MD knuckles and the highest point on the CD knuckles is from about 0.001 to about 0.02 or 0.03 inch, (4) in between these two levels can be knuckles formed either by MD or CD strands that give the topography a three dimensional hill/valley appearance that is imparted to the sheet, (5) the fabric may be oriented in any suitable way so as to achieve the desired effect on processing and on properties in the product, the long warp knuckles may be on the top side to increase MD ridges in the product, or the long shute knuckles may be on the top side, if more CD ridges are desired to influence creping characteristics as the web is transferred from the transfer cylinder to the creping fabric, and (6) the fabric may be made to show certain geometric patterns that are pleasing to the eye, which is typically repeated between every two to 50 warp yarns. Suitable commercially available coarse fabrics include a number of fabrics made by Voith Fabrics, as mentioned above.

The creping fabric may thus be of the class described in U.S. Pat. No. 5,607,551 to Farrington et al., cols. 7-8 thereof, as well as the fabrics described in U.S. Pat. No. 4,239,065 to Trokhan and U.S. Pat. No. 3,974,025 to Ayers. Such fabrics may have about 20 to about 60 filaments per inch and are formed from monofilament polymeric fibers having diameters typically ranging from about 0.008 to about 0.025 inches. Both warp and weft monofilaments may, but need not necessarily, be of the same diameter.

In some cases, filaments are so woven and complimentarily serpentinely configured in at least the Z-direction (the thickness of the fabric) to provide a first grouping or array of coplanar top-surface-plane crossovers of both sets of filaments, and a predetermined second grouping or array of sub-top-surface crossovers. The arrays are interspersed so that portions of the top-surface-plane crossovers define an array of wicker-basket-like cavities in the top surface of the fabric, which cavities are disposed in staggered relation in both the machine direction (MD) and the cross-machine direction (CD), and so that each cavity spans at least one sub-top-surface crossover. The cavities are discretely perimetrically enclosed in the plan view by a picket-like lineament comprising portions of a plurality of the top-surface plane crossovers. The loop of fabric may comprise heat set monofilaments of thermoplastic material, the top surfaces of the coplanar top-surface-plane crossovers may be monoplanar flat surfaces. Specific embodiments of the invention include satin weaves, as well as hybrid weaves of three or greater sheds, and mesh counts of from about 10 H10 to about 120 H 120 filaments per inch (4 H 4 to about 47 H 47 per centimeter), although the preferred range of mesh counts is from about 18 by 16 to about 55 by 48 filaments per inch (9 H 8 to about 22 H 19 per centimeter).

Instead of an impression fabric, as described immediately above, a dryer fabric may be used as the creping fabric, if so desired. Suitable dryer fabrics are described in U.S. Pat. Nos. 5,449,026 (woven style) and 5,690,149 (stacked MD tape yarn style) to Lee as well as U.S. Pat. No. 4,490,925 to Smith (spiral style).

Can drying can be used alone or in combination with impingement-air drying, the combination being especially convenient if a two tier drying section layout is available. Impingement-air-drying may also be used as the only means of drying the web. Suitable rotary impingement-air drying equipment is described in U.S. Pat. No. 6,432,267 to Watson and U.S. Pat. No. 6,447,640 to Watson et al. Inasmuch as the process of the invention can readily be practiced on existing equipment with reasonable modifications, any existing flat dryers can be advantageously employed so as to conserve capital as well. Alternatively, the web may be through-dried before or after fabric creping as is well known in the art. Representative references include: U.S. Pat. No. 3,432,936 to Cole et al.; U.S. Pat. No. 3,994,771 to Morgan, Jr. et al.; U.S. Pat. No. 4,102,737 to Morton; and U.S. Pat. No. 4,529,480 to Trokhan.

The desired redistribution of fiber is achieved by an appropriate selection of consistency, fabric or fabric pattern, nip parameters, and velocity delta, the difference in speed between the transfer surface and creping fabric. Velocity deltas of at least 100 fpm, 200 fp, 500 fpm, 1000 fpm, 1500 fpm or even in excess of 2000 fpm may be needed under some conditions to achieve the desired redistribution of fiber and combination of properties, as will become apparent from the discussion that follows. In many cases, velocity deltas of from about 500 fpm to about 2000 fpm will suffice. Forming of the nascent web, for example, control of a headbox jet and forming wire or fabric speed is likewise important in order to achieve the desired properties of the product, especially, MD/CD tensile ratio.

The following salient parameters are selected or controlled in order to achieve a desired set of characteristics in the product: consistency at a particular point in the process (especially at fabric crepe), fabric pattern, fabric creping nip parameters, fabric crepe ratio, velocity deltas, especially, transfer surface/creping fabric and headbox jet/forming wire, and post fabric-crepe handling of the web. The products of the invention are compared with conventional products in Table 2 below.

TABLE 2

Comparison of Typical Web Properties

| Property | Conventional Wet Press | Conventional Throughdried | High Speed Fabric Crepe |
|---|---|---|---|
| SAT g/g | 4 | 10 | 6-9 |
| *Caliper | 40 | 120+ | 50-115 |
| MD/CD Tensile | >1 | >1 | <1 |
| CD Stretch (%) | 3-4 | 7-15 | 5-15 |

A rush transfer is optionally performed prior to fabric creping from the transfer surface. A rush transfer is carried out at a web consistency of from about 10 to 30 percent, preferably, less than 30 percent, and occurs as a fixed gap transfer as opposed to fabric creping under pressure. Typically, a rush transfer is carried out at a Rush Transfer of from about 10 to about 30 percent at a consistency of from about 10 to about 30 percent, while a high solids fabric crepe in a pressure nip is usually at a consistency of at least 35 percent. Further details as to Rush Transfer appear in U.S. Pat. No. 4,440,597 to Wells et al. Typically, rush transfer is carried out using a vacuum to assist in detaching the web from the donor fabric and, thereafter, attaching it to the receiving or receptor fabric. In contrast, a vacuum is not required in a fabric creping step, so, accordingly, when we refer to fabric creping as being "under pressure", we are referring to loading of the receptor fabric against the transfer surface, although vacuum assist can be employed at the expense of further complicating the system, as long as the amount of vacuum is not sufficient to interfere with the rearrangement or redistribution of the fiber.

If a Fourdrinier former is used, the nascent web is conditioned with vacuum boxes and a steam shroud until it reaches a solids content suitable for transferring to a dryer fabric. The nascent web may be transferred with vacuum assistance to the fabric.

Throughout the specification and claims, when we refer to drying the web while it is held "in the creping fabric" or use like terminology, we mean that a substantial portion of the web protrudes into the interstices of the creping fabric, while, of course, another substantial portion of the web lies in close contact therewith.

Figure 2:
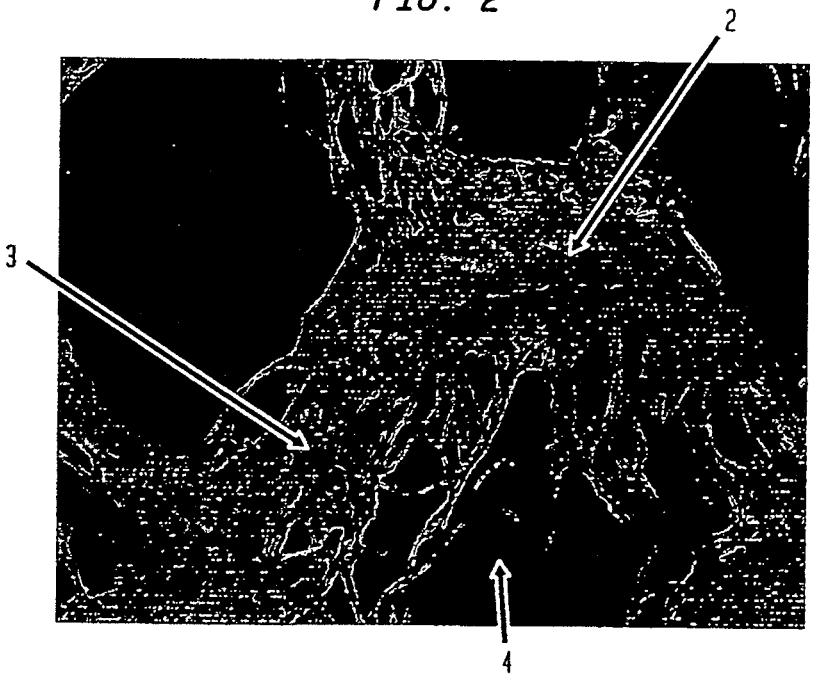
FIG. 2 is a photomicrograph showing an enlarged detail (32×) of the web of FIG. 1.

The invention process and preferred products thereof are appreciated by reference to FIGS. 1 through 18. FIG. 1 is a photomicrograph of a very low basis weight, open mesh web 1 having a plurality of relatively high basis weight pileated regions 2 interconnected by a plurality of lower basis weight linking regions 3. The cellulosic fibers of linking regions 3 have an orientation that is biased along the direction as to which they extend between pileated regions 2, as is perhaps best seen in the enlarged view of FIG. 2. The orientation and variation in local basis weight is surprising in view of the fact that the nascent web has an apparently random fiber orientation when formed, and is transferred largely undisturbed to a transfer surface prior to being wet-creped therefrom. The imparted ordered structure is distinctly seen at extremely low basis weights where web 1 has open portions 4 and is, thus, an open mesh structure.

Figure 3:
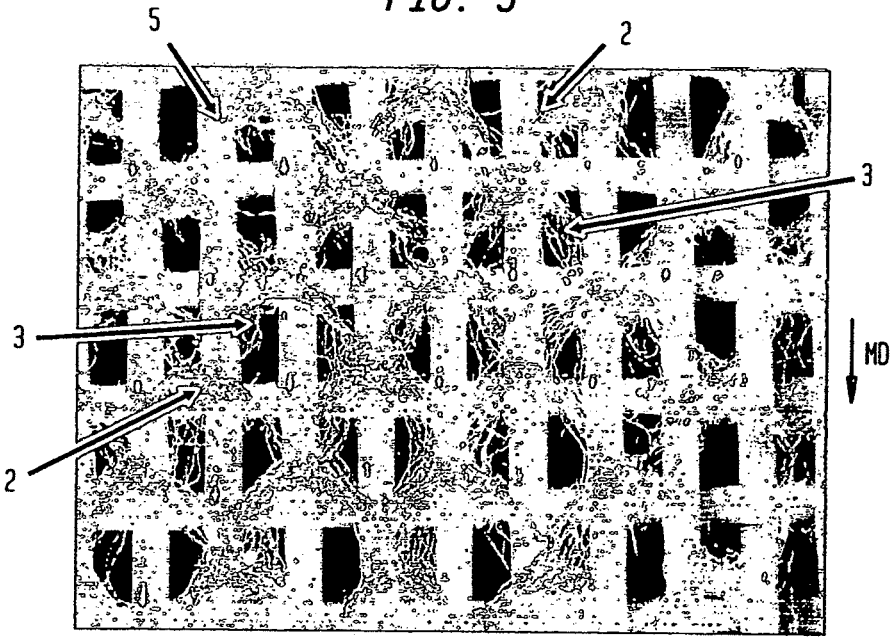
FIG. 3 is a photomicrograph (8×) showing the open mesh web of FIG. 1 placed on the creping fabric used to manufacture the web.

FIG. 3 shows a web together with the creping fabric 5 upon which the fibers were redistributed in a wet-creping nip after generally random formation to a consistency of 40-50 percent or so prior to creping from the transfer cylinder.

Figure 4:
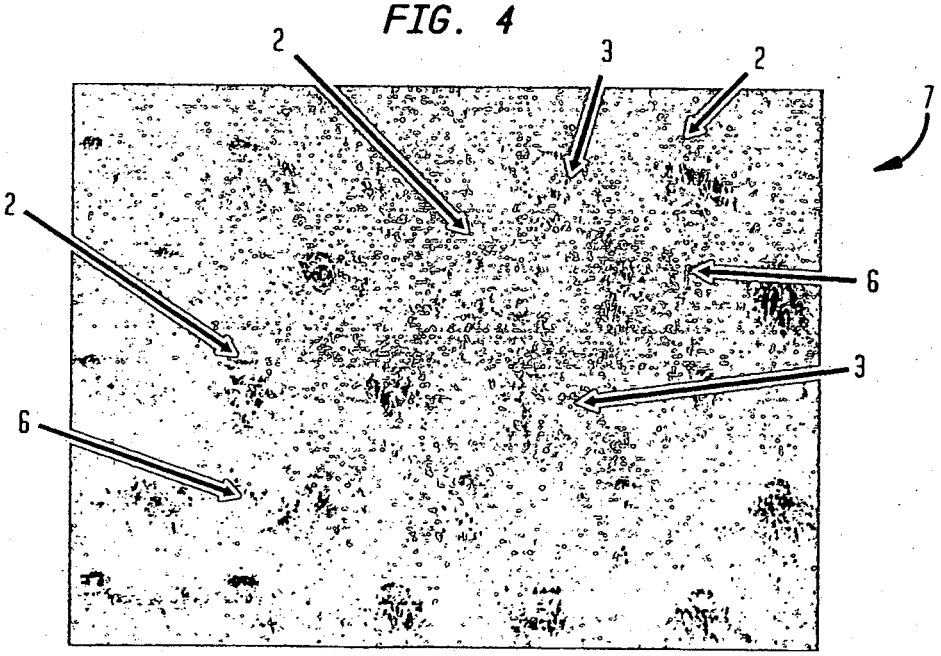
FIG. 4 is a photomicrograph showing a web having a basis weight of 19 lbs/ream produced with a 17% Fabric Crepe.
Figure 5:
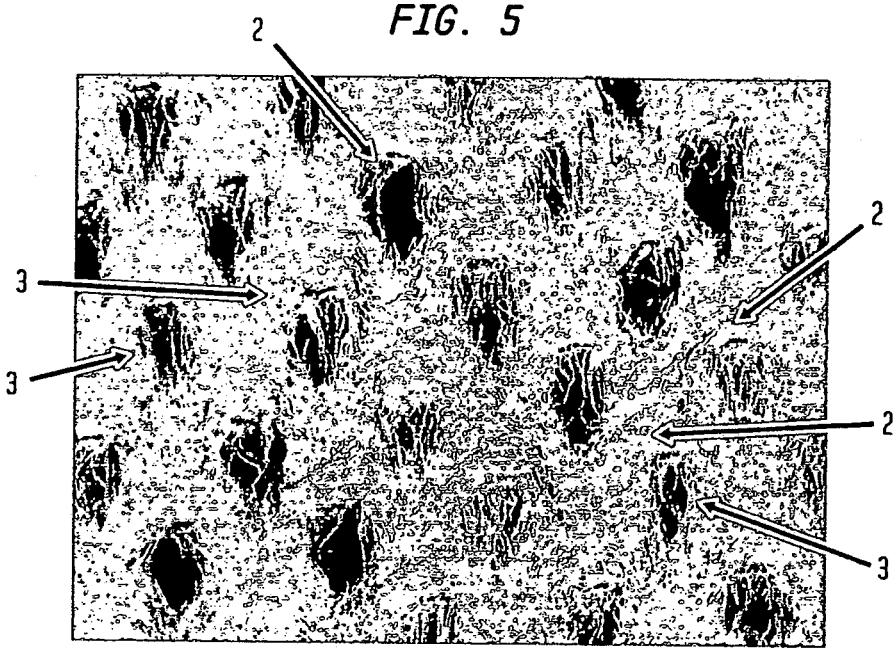
FIG. 5 is a photomicrograph showing a web having a basis weight of 19 lbs/ream produced with a 40% Fabric Crepe.
Figure 6:
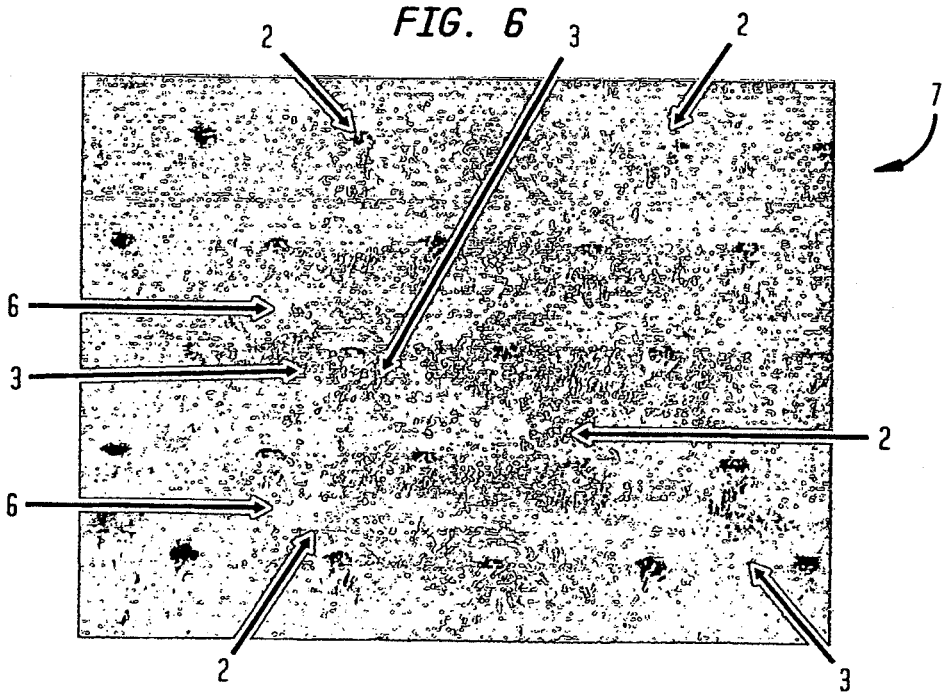
FIG. 6 is a photomicrograph showing a web having a basis weight of 27 lbs/ream produced with a 28% Fabric Crepe.

While the structure, including the pileated and reoriented regions, is easily observed in open meshed embodiments of very low basis weight, the ordered structure of the products of the invention is likewise seen when basis weight is increased where integument regions of fiber 6 span the pileated and linking regions, as is seen in FIGS. 4 through 6, so that a sheet 7 is provided with substantially continuous surfaces, as is seen, particularly, in FIGS. 4 and 6, where the darker regions are lower in basis weight, while the almost solid white regions are relatively compressed fiber.

The impact of processing variables, and so forth, are also appreciated from FIGS. 4 through 6. FIGS. 4 and 5 both show 19 lb sheet; however, the pattern in terms of variation in basis weight is more prominent in FIG. 5, because the Fabric Crepe was much higher (40% vs. 17%). Likewise, FIG. 6 shows a higher basis weight web (27 lb) at 28% crepe where the pileated, linking and integument regions are all prominent.

Redistribution of fibers from a generally random arrangement into a patterned distribution including orientation bias, as well as fiber enriched regions corresponding to the creping fabric structure, is still further appreciated by reference to FIGS. 7 through 18.

Figure 7:
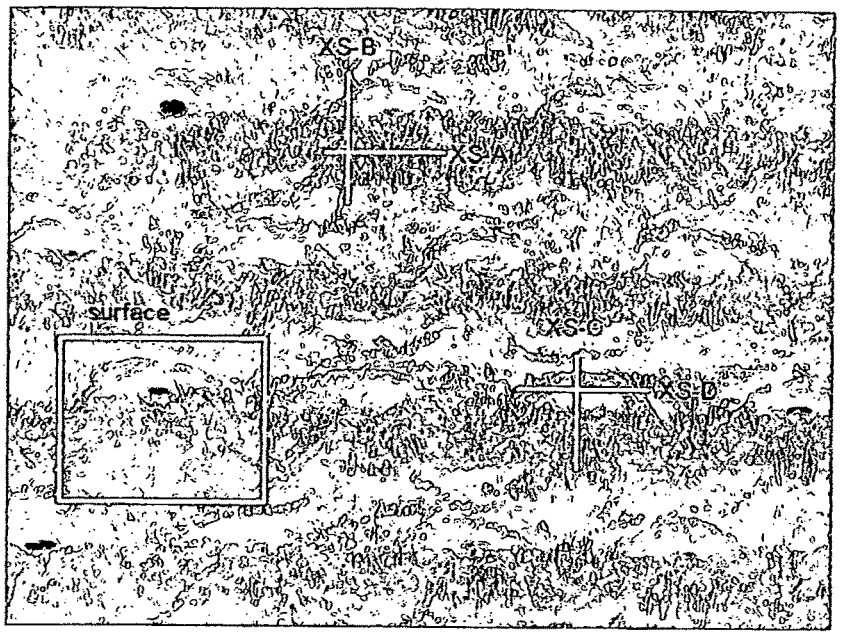
FIG. 7 is a surface image (10×) of an absorbent sheet, indicating areas where samples for surface and section scanning electron micrographs (SEMs) were taken.
Figure 8:
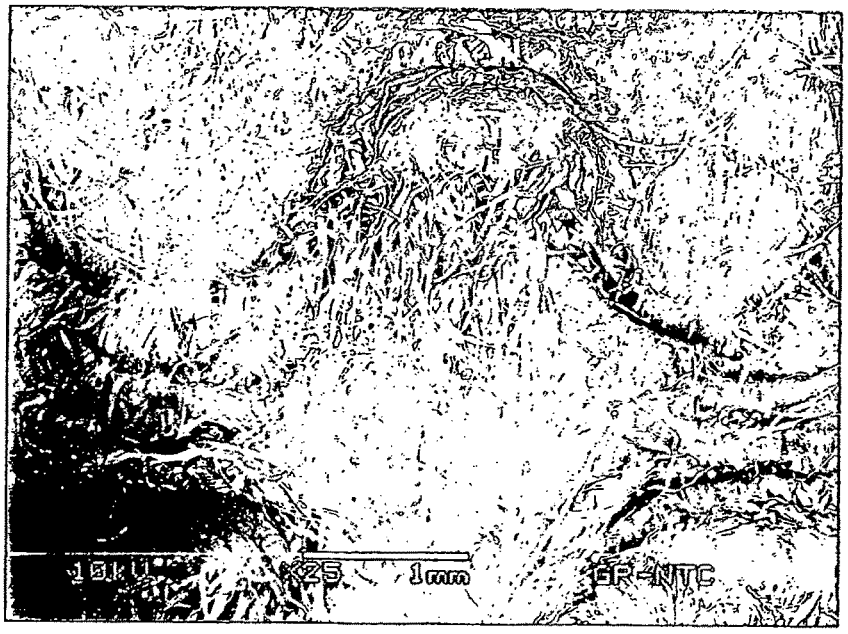
FIGS. 8-10 are surface SEMs of a sample of a material taken from the sheet seen in FIG. 7.
Figure 9:
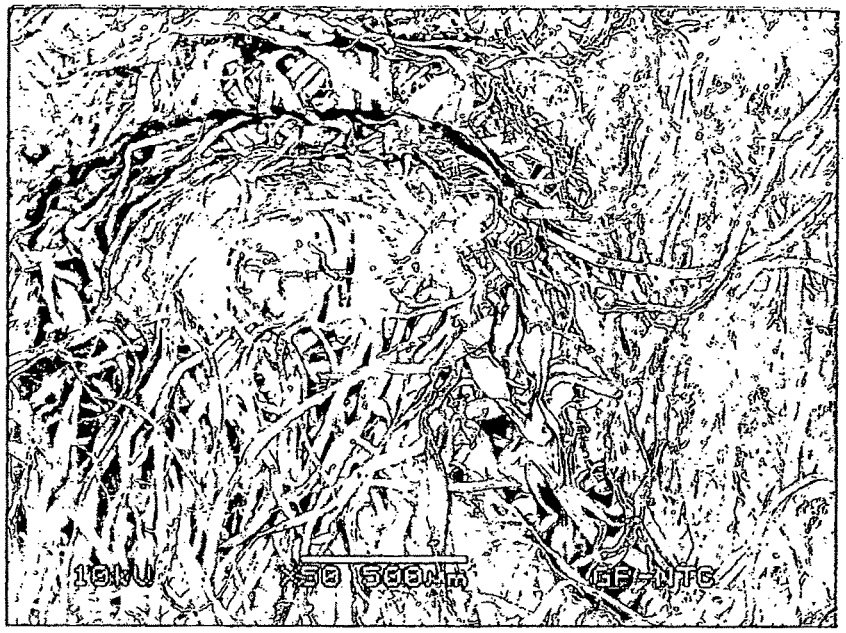
Figure 10:
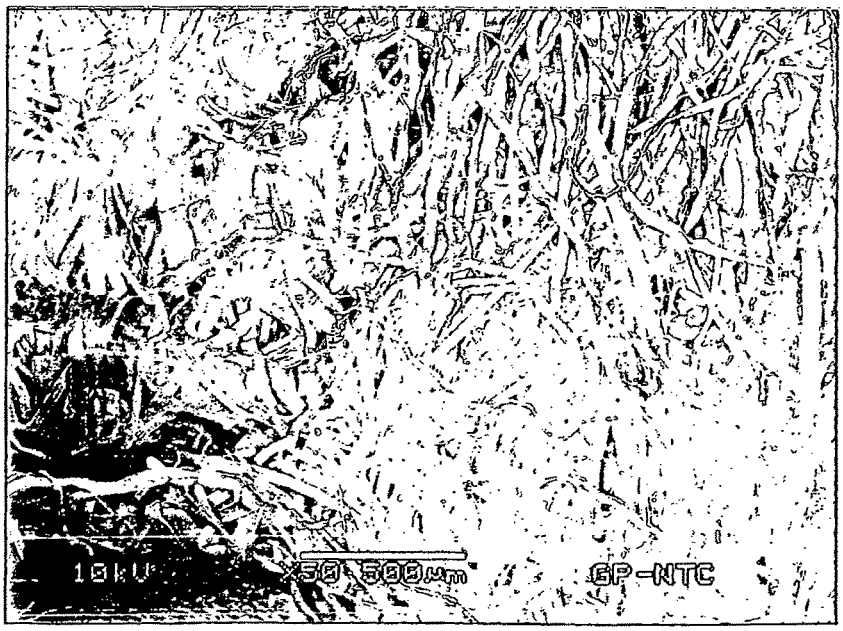
Figure 11:
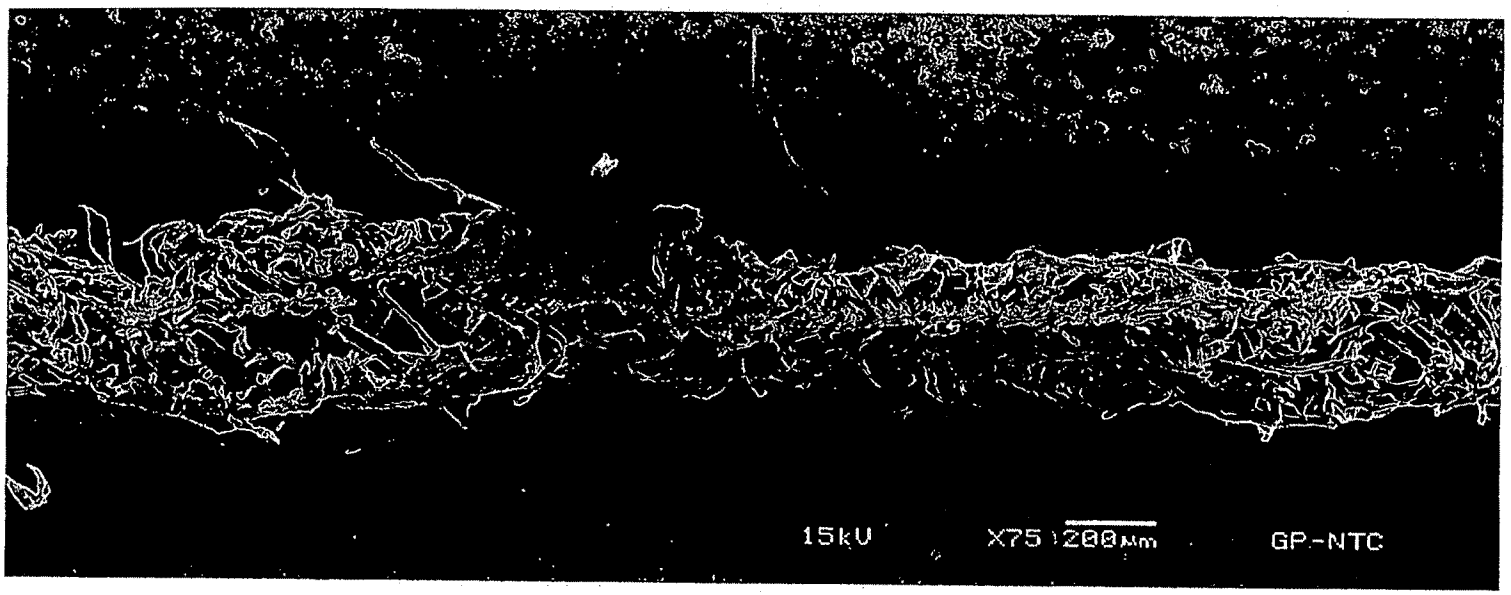
FIGS. 11 and 12 are SEMs of the sheet shown in FIG. 7 in section across the MD.
Figure 12:
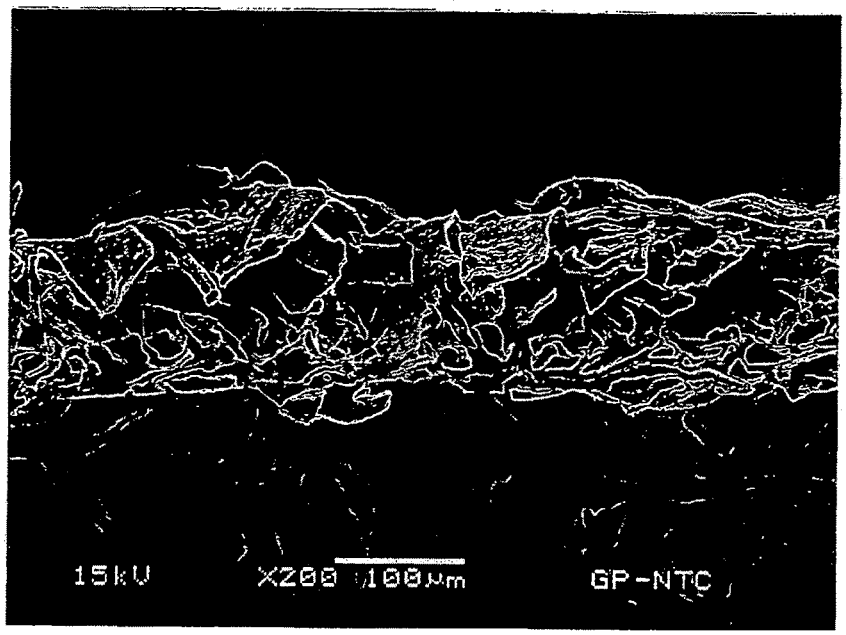

FIG. 7 is a photomicrograph (10×) showing a cellulosic web from which a series of samples was prepared and scanning electron micrographs (SEMs) made to further show the fiber structure. The left of FIG. 7 shows a surface area from which the SEM surface images 8, 9 and 10 were prepared. It is seen in these SEMs that the fibers of the linking regions have an orientation biased along their direction between pileated regions, as was noted earlier in connection with the photomicrographs. It is further seen in FIGS. 8, 9 and 10 that the integument regions formed have a fiber orientation along the machine-direction. The feature is illustrated rather strikingly in FIGS. 11 and 12.

Figure 13:
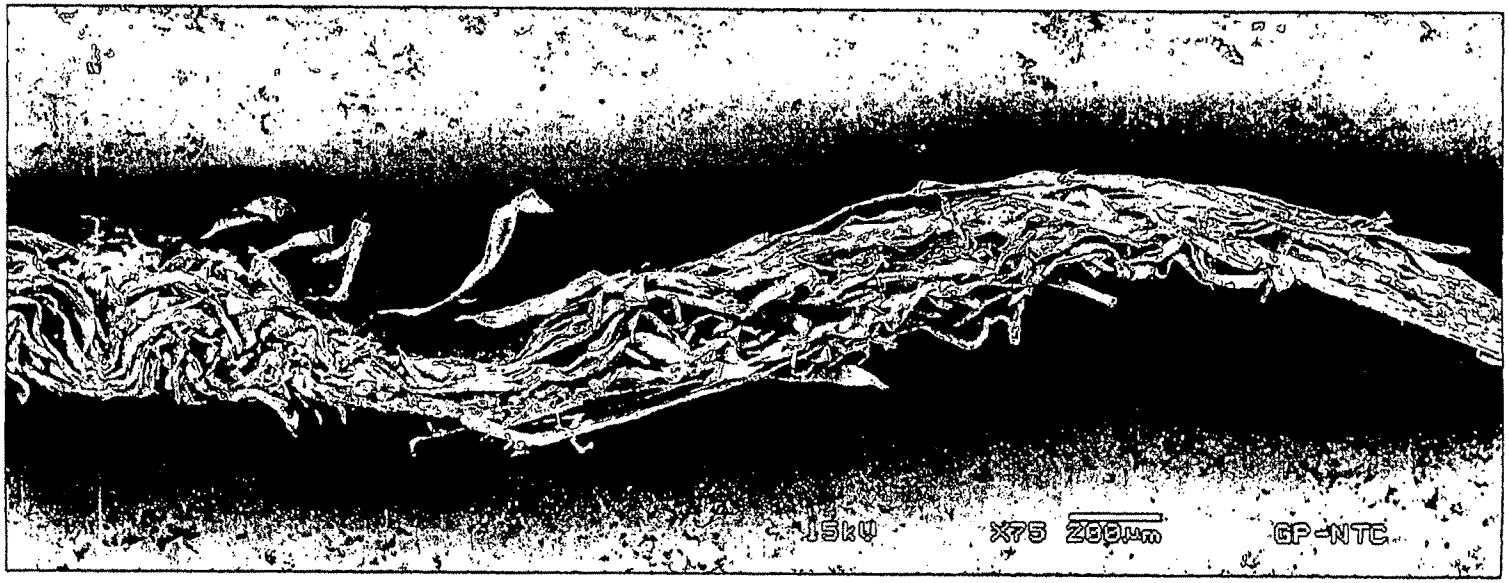
FIGS. 13 and 14 are SEMs of the sheet shown in FIG. 7 in section along the MD.
Figure 14:
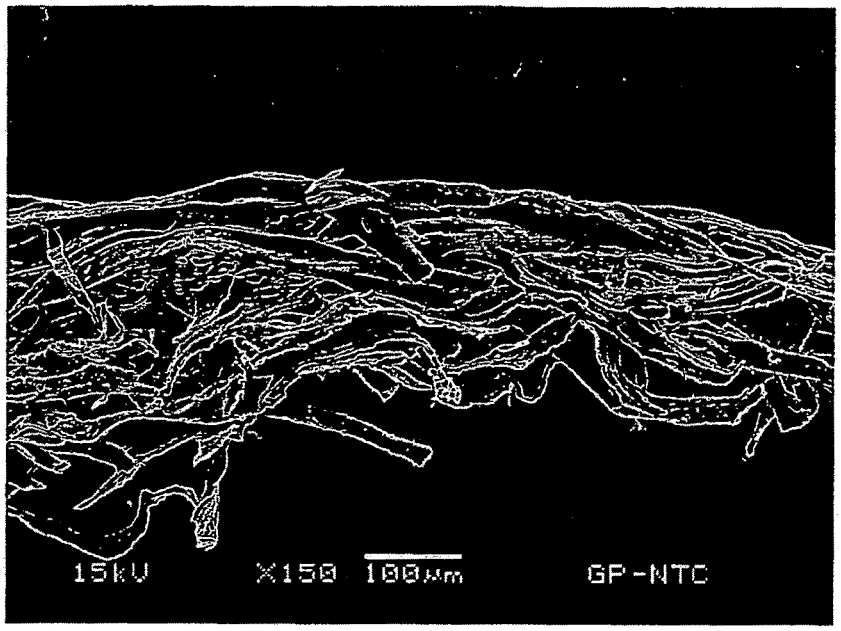

In FIGS. 13 and 14, a section along line XS-B of the sample of FIG. 7, shows fewer cut fibers, especially, at the middle portions of the photomicrographs, again showing an MD orientation bias in these areas. Note, in FIG. 13, U-shaped folds are seen in the fiber enriched area to the left. See also, FIG. 15.

Figure 15:
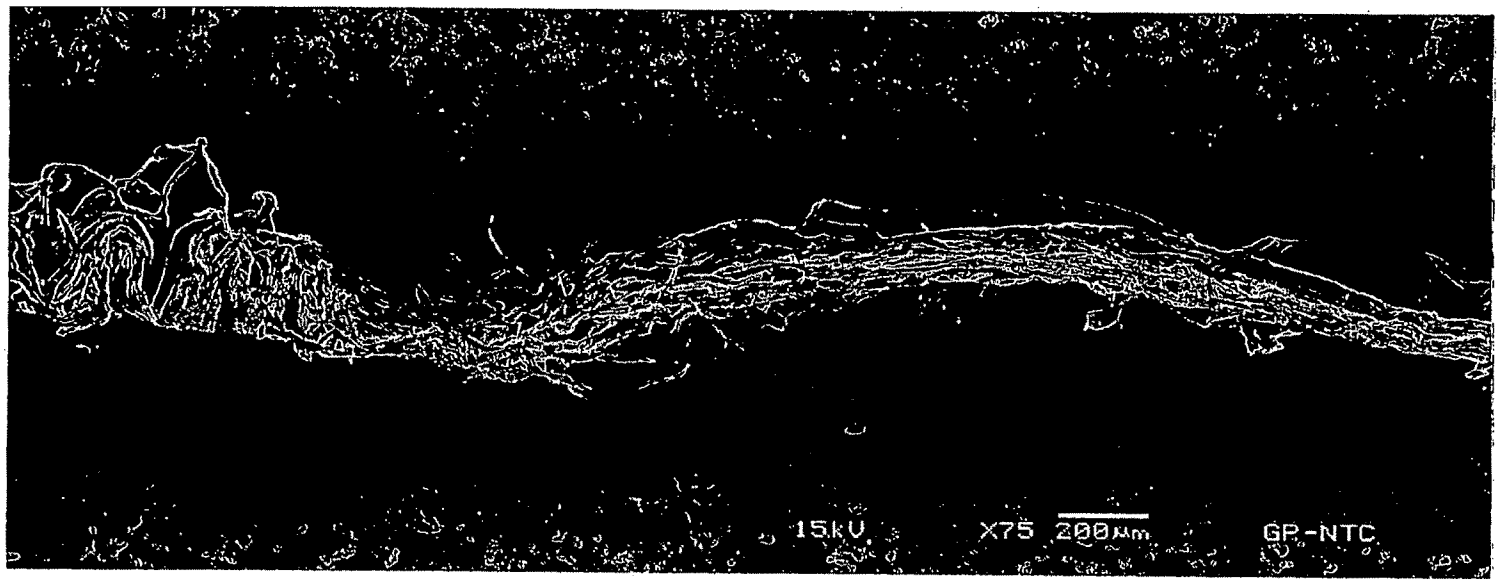
FIGS. 15 and 16 are SEMs of the sheet shown in FIG. 7 in section also along the MD.
Figure 16:
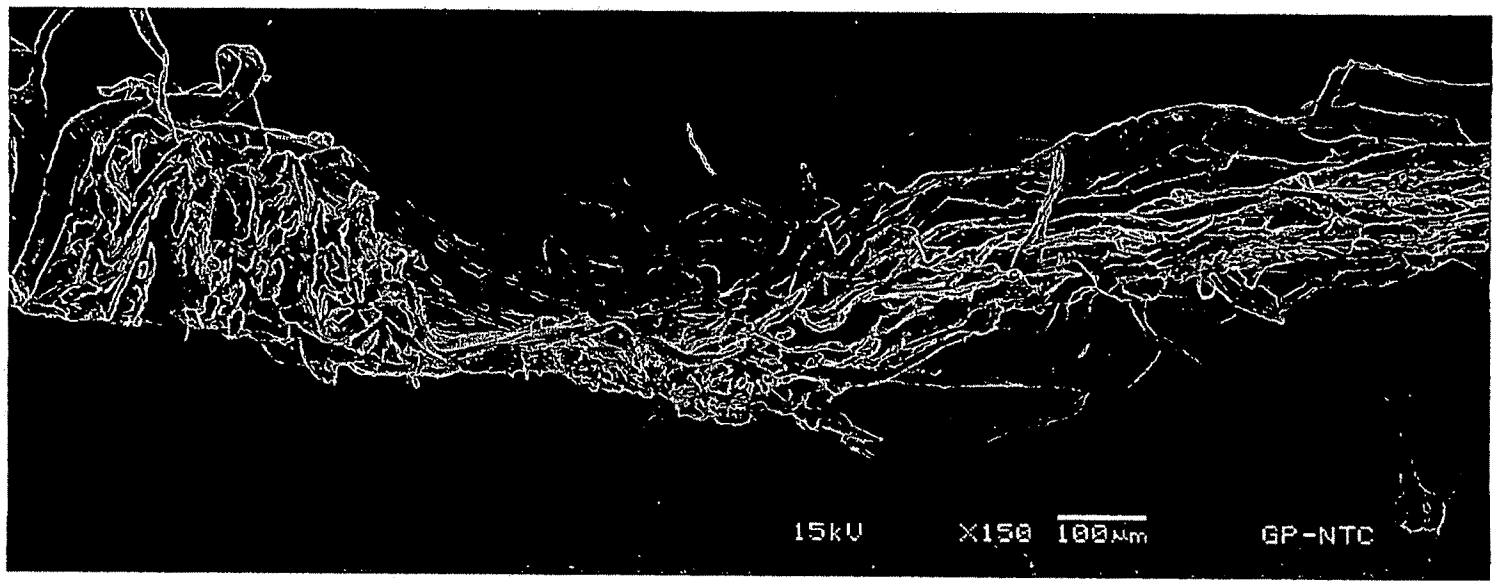

FIGS. 15 and 16 are SEMs of a section of the sample of FIG. 7 along the line XS-C. It is seen in these Figures that the pileated regions (left side) are "stacked up" to a higher local basis weight. Moreover, it is seen in the SEM of FIG. 16 that a large number of fibers have been cut in the pileated region (left), showing reorientation of the fibers in this area in a direction transverse to the MD, in this case, along the CD. Also noteworthy is that the number fiber ends observed diminishes as one moves from left to right, indicating an orientation toward the MD as one moves away from the pileated regions.

Figure 17:
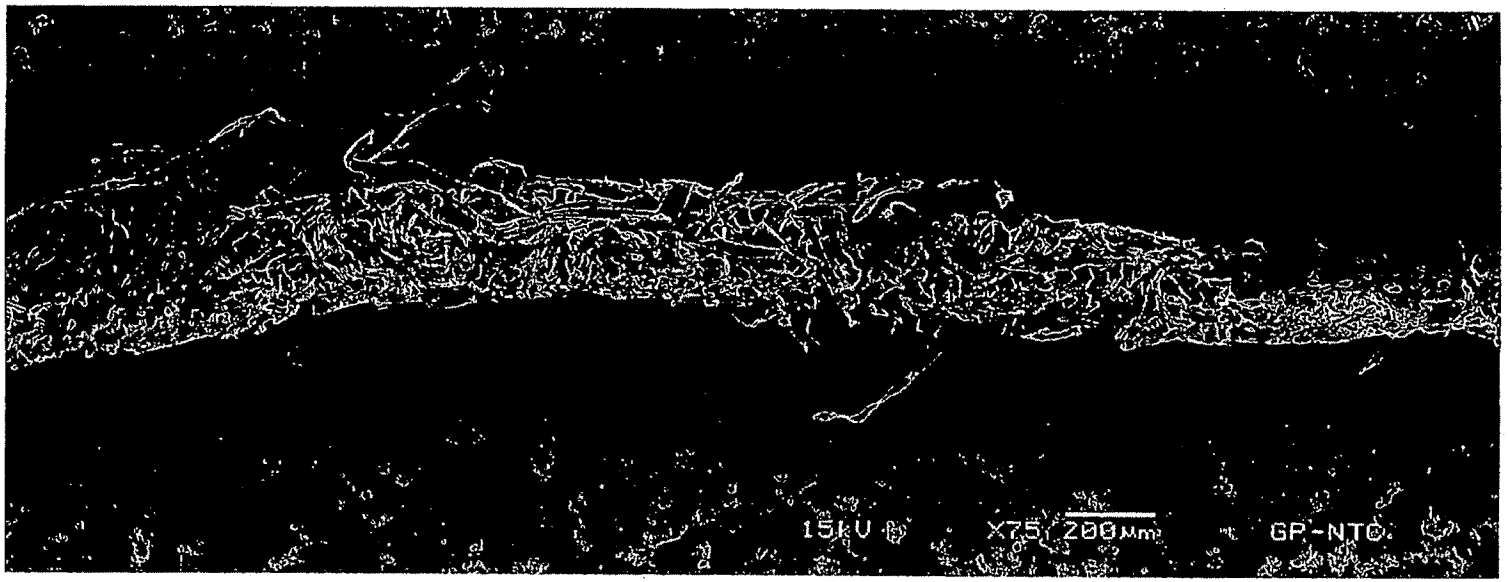
FIGS. 17 and 18 are SEMs of the sheet shown in FIG. 7 in section across the MD.
Figure 18:
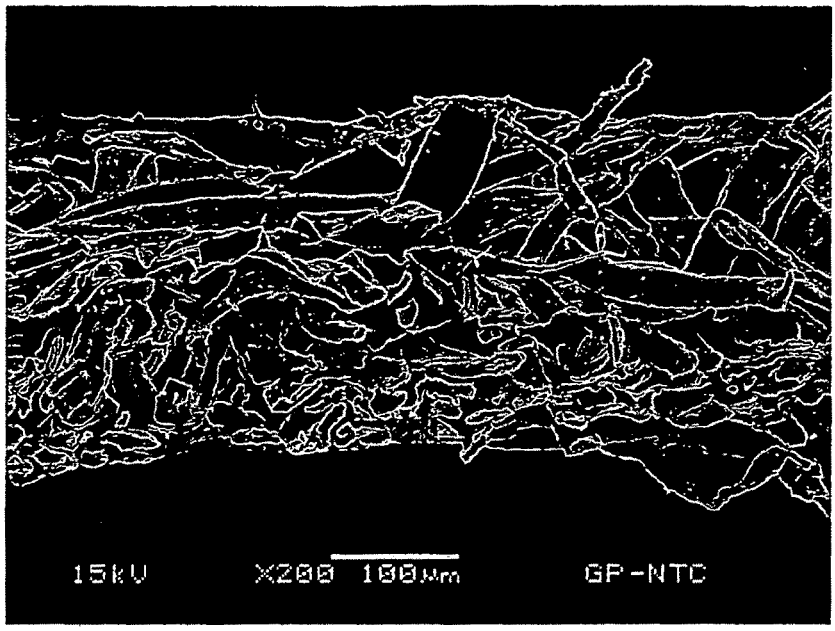

FIGS. 17 and 18 are SEMs of a section taken along line XS-D of FIG. 7. Here, it is seen that fiber orientation bias changes as one moves across the CD. On the left, in a linking or colligating region, a large number of "ends" are seen, indicating MD bias. In the middle, there are fewer ends as the edge of a pileated region is traversed, indicating more CD bias until another linking region is approached, and cut fibers again become more plentiful, again, indicating increased MD bias.

Figure 19:
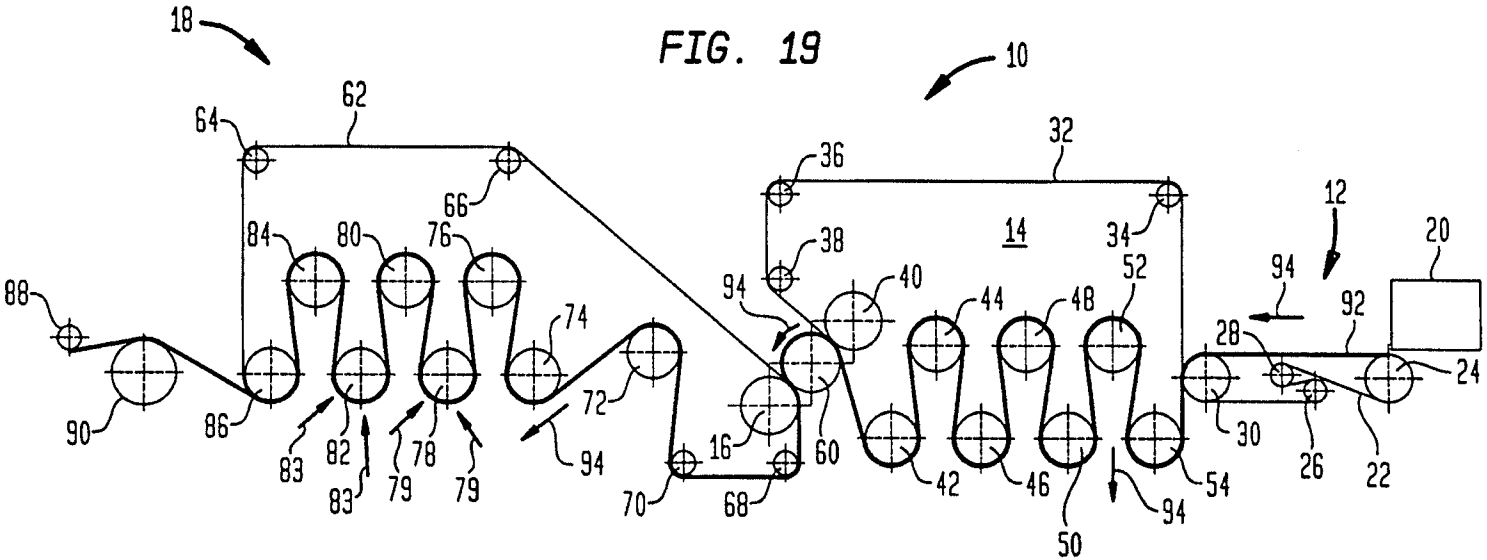
FIG. 19 is a schematic diagram of a first paper machine used to produce absorbent sheet in accordance with the present invention.
Figure 19A:
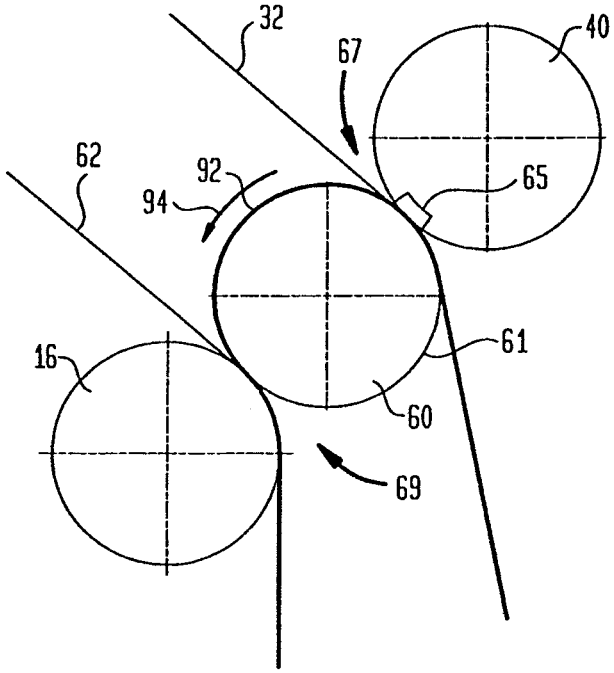
FIG. 19A is an enlarged portion showing the transfer nip and creping nip of FIG. 19.

Referring now to FIGS. 19 and 19A, a paper machine 10 is shown suitably arranged for practicing the present invention. Paper machine 10 includes a forming section 12, a first can drying section 14, a crepe roll 16, and a second drying section 18. Section 12 is referred to in the art as a Fourdrinier former. The former includes a head box 20, a forming fabric or wire 22, and a plurality of rollers. Included are forming roll 24, support rolls 26 and 28 and transfer roll 30.

Adjacent forming section 12 is a first can drying section 14 that includes a dryer fabric 32, as well as a plurality of support rollers. Thus included are support rolls 34, 36, and 38, as well as a shoe press roll 40 and heated cans 42, 44, 46, 48, 50, 52, and 54.

A transfer roll 60 is provided adjacent to first can drying section 14.

Transfer roll 60 is in contact with an impression fabric 62, which, in turn, is supported by a plurality of rollers, as is seen in the diagram. Thus, support rollers 64, 66, 68, and so forth, are provided. Roller 68 is advantageously a suction roll. Fabric 62 is also carried on roller 70 and dryer cans 72, 74, 76, 78, 80, 82, 84 and 86 before being wound up on a reel 88. A guide roll 90 is optionally provided.

Dryer section 18, cans 76, 80 and 84, are in a first tier and cans 74, 78, 82 and 86 are in a second tier. Cans 76, 80 and 84 directly contact the web, whereas cans in the other tier contact the fabric. In this two tier arrangement where the web is separated from cans 78 and 82 by the fabric, it is sometimes advantageous to provide impingement-air dryers at 78 and 82, which may be drilled cans, such that air flow is generated, as is indicated schematically at 79 and 83. Impingement-air dryers may be similarly employed in first can dryer section 14, if so desired.

In operation, a paper making furnish at a low consistency (less than 1 percent) is provided by way of head box 20 onto wire 22 to form a web 92. The web proceeds through machine 10 in the machine direction indicated by arrows 94 to reel 88.

On forming wire 22, the nascent web increases in consistency up to a consistency of from about 10 to 15 percent. The web is then transferred to fabric 32. Fabric 32 is an impression fabric or a dryer fabric, as described above. The web is then dried as it passes over dryer cans 54, 52, 50, 48, 46, 44, and 42. Note that the web is in direct contact with dryer cans 52, 48, and 44 and is disposed on the fabric, which lies between the web and dryer cans 54, 50, 46 and 42. In other words, the web 92 is in proximity to cans 54, and so forth. It is, however, separated therefrom by the fabric. At this point in the process, the web has an apparently random distribution of fiber orientation.

As the web proceeds in the machine direction and is dried by the cans, it is typically raised to a consistency of from about 30 to about 60 percent before being transferred to transfer roll 60. Transfer roll 60 has a rotating transfer surface 61, rotating at a first speed. The web is transferred from fabric 32 to surface 61 of roll 62 by way of roll 40. Roll 40 may be a shoe press roll and incorporates a shoe 65 in order to assist in transferring the web. Inasmuch as fabric 32 is an impression fabric or a dryer fabric, there is not a substantial change in the consistency of the web upon transfer to rotating cylinder 60. The transfer occurs in transfer nip 67, whereupon, web 92 is transferred to surface 61 of cylinder 60 and conveyed to impression fabric 62.

A creping adhesive is optionally used to secure the web to the surface of cylinder 60, but the adhesive is not typically necessary.

The web is creped from surface 61 in a creping nip 69 (FIG. 19A), wherein the web is most preferably rearranged on the creping fabric, so that it no longer has an apparently random distribution of fiber orientation, rather, the orientation is patterned. That is to say, the web has a non-random orientation bias in a direction other than the machine-direction after it has been creped. To improve processing, it is preferred that creping roll 16 has a relatively soft cover, for example, a cover with a Pusey and Jones hardness of from about 25 to about 90.

Following the creping nip, the web is conveyed on fabric 62 to a plurality of can dryers 72, 74, 76, 78, 80, 82, 84, and 86 in the direction indicated by arrows 94. Preferably, roll 68 is a suction roll in order to prevent loss of adhesion between the fabric and the web. Likewise, roll 70 may be a suction roll, if so desired. After drying, the web has a consistency anywhere from about 92 to 98 percent, in most cases, as it is wound up on take up roll 88.

In some embodiments of the invention, it is desirable to eliminate open draws in the process, such as the open draw between the creping and drying fabric and take up roll 88. This is readily accomplished by extending the creping fabric to the reel drum and transferring the web directly from the fabric to the reel, as is disclosed generally in U.S. Pat. No. 5,593,545 to Rugowski et al.

The present invention offers the advantage that relatively low grade energy sources may be used to provide the thermal energy used to dry the web. That is to say, it is not necessary in accordance with the invention to provide through-drying quality heated air or heated air suitable for a drying hood, inasmuch as they may be heated from any source, including waste recovery. Also, existing facility thermal recovery is used, since equipment changes to implement the process are minimal. Generally, a significant advantage of the invention is that it may utilize large portions of existing manufacturing assets, such as can dryers and Fourdrinier formers of flat paper machines, in order to make premium basesheet for tissue and towel, requiring only modest modification to the existing assets, thus, lowering dramatically the required capital investment to make premium products.

Figure 20:
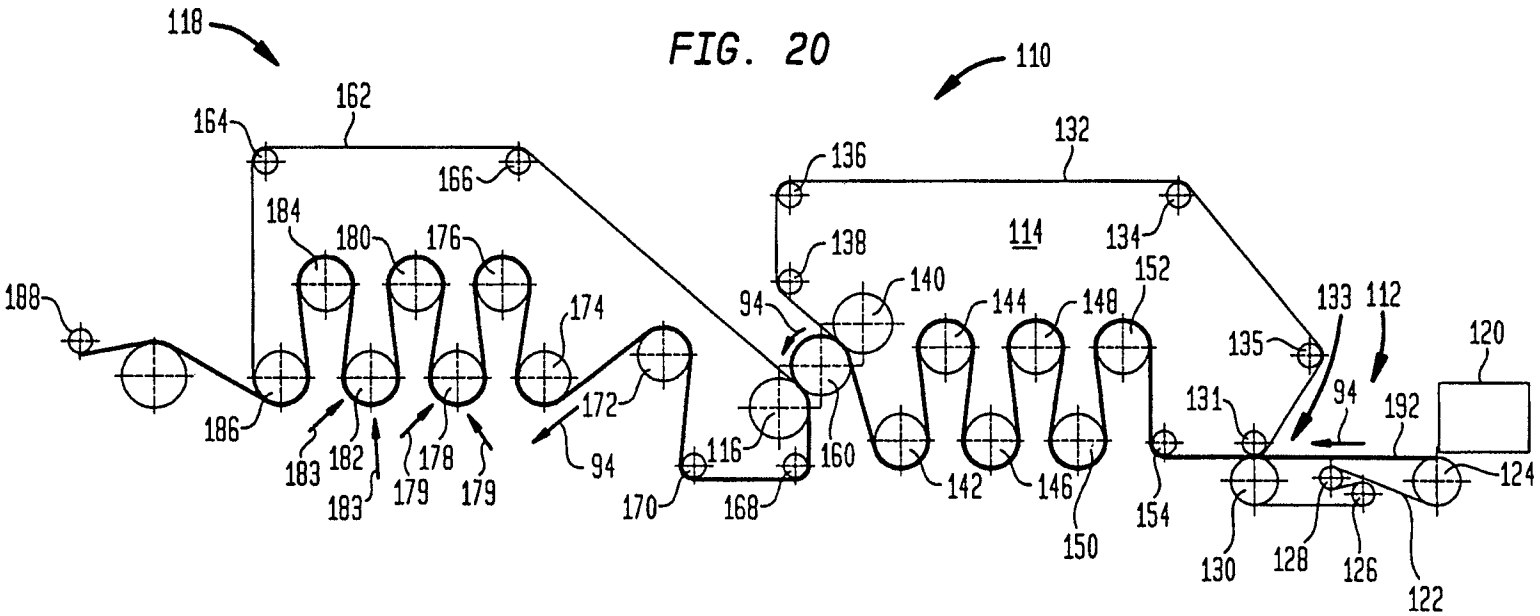
FIG. 20 is a schematic diagram of a second paper machine used to produce absorbent sheet in accordance with the present invention.

FIG. 20 shows yet another paper machine 110 useful for practicing the present invention. Machine 110 includes a forming section 112, a first drying section 114, a crepe roll 116, as well as a second can drying section 118. Forming section 112 includes a head box 120, as well as a forming wire 122. Forming wire 122 is supported on forming rolls 124, support rolls 126, and 128, as well as transfer roll 130. The particular configuration of the forming section shown in FIG. 20 is known in the art as a Fourdrinier former. Adjacent to forming section 112 is a fixed gap transfer nip 133 where the web is transferred to a dryer fabric 132, with the assistance of a transfer vacuum shoe 131 and, subsequently, dried in drying section 114. Drying section 114 is configured to dewater the web to a consistency suitable for fabric creping at high solids. On forming wire 122, the nascent web 192 is initially dewatered to a consistency of anywhere from about 10 to about 30 percent from a feed consistency of less than 1 percent, optically, using vacuum boxes, and the like (not shown). Drying section 114 includes dryer fabric 132 supported on a plurality of rolls, such as rolls 134, 135, 136, 138, 154, as well as dryer cans 142, 144, 146, 148, 150, and 152. Press roll 140, which may be a shoe press roll, as noted above, may also be provided.

After the web is formed on wire 122, it moves in the direction shown by arrow 94, and is rush transferred to dryer fabric 132 in fixed gap transfer nip 133. Thereafter, the web continues to move on fabric 132 around the first drying can section including cans 142, 144, 146, 148, 150, and 152, as indicated toward transfer roll 160. Fabric 132 travels slower than wire 122, such that a Rush Transfer of from about 10 to about 30 percent is typical.

Over the can dryers, the web is dried to a consistency of between about 30 and 60 percent, in most cases. Thereafter, the web is transferred in a transfer nip to a transfer cylinder 160 having a transfer surface. Upon transfer to cylinder 160, the web 192 has a consistency of typically from about 45 to about 60 percent. The transfer cylinder transfers the web to dryer section 118 by way of impression fabric 162.

That is to say, impression fabric 162 forms a fabric creping nip with transfer cylinder 160 by virtue of the fact that fabric 162 is pressed against the transfer cylinder by creping roll 116. Any suitable creping pressure may be used, such as a pressure of between about 40 and 80 pounds/linear inch (PLI). Creping fabric 190 is supported on a plurality of rolls 164, 166, as well as dryer cans 172, 174, 176, 178, 180, 182, 184 and 186. At dryer can 186, web 192 is separated from fabric 162 and reeled onto product reel 188.

The particular embodiment of FIG. 20 utilizes a rush transfer to provide further crepe to the web in its formative stages, so that the product has even more bulk and stretch. In other respects, the embodiment FIG. 20 (wherein parts are number 100 numerals higher than corresponding parts in FIGS. 19 and 19A) is constructed and performs similarly to those parts in the embodiment of FIGS. 19 and 19A, and will not be discussed further here for purposes of brevity. Suffice it to say, for present purposes, that the web is pressed onto cylinder 160 by way of press roll 140. Thereafter, the web is transferred from the surface of roll 160, traveling at a first speed, to fabric 162, traveling at a second, slower speed. The web is thus fabric creped from cylinder 160, most preferably, in such a manner that the fabric effectively rearranges the web into a pattern. Prior to transfer to the fabric, the web has an apparently random fiber distribution.

Figure 21:
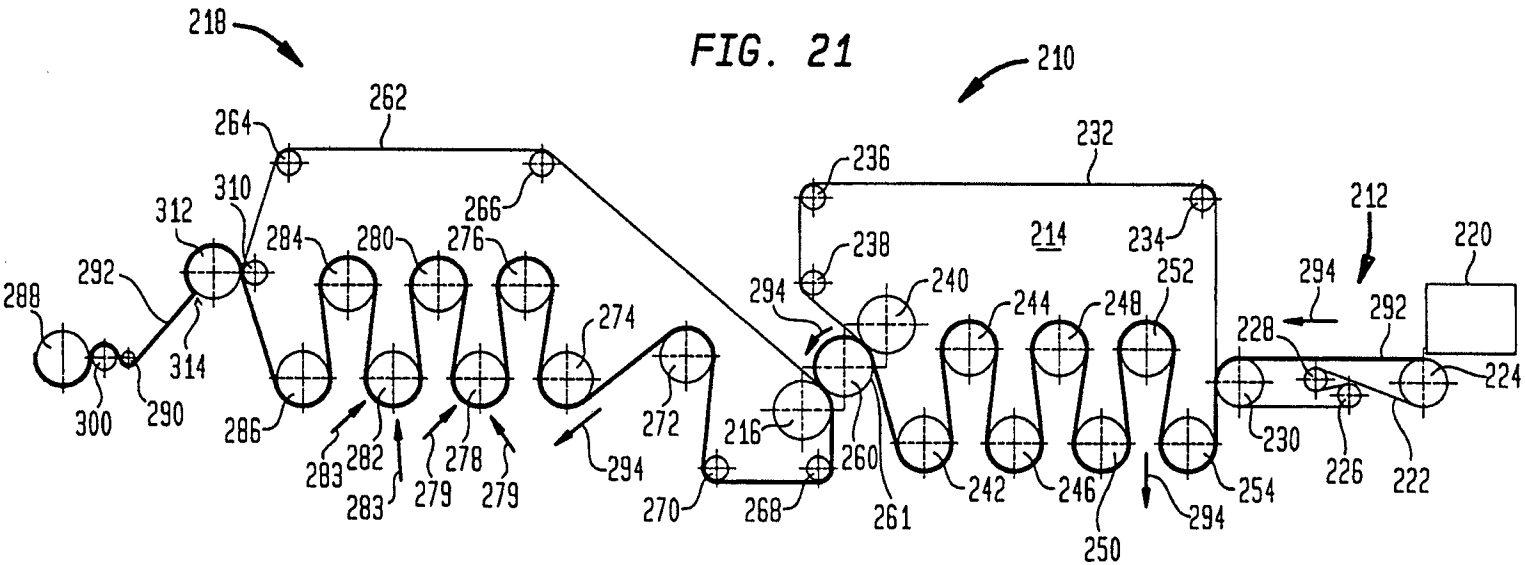
FIG. 21 is a schematic diagram of a third paper machine used to produce absorbent sheet in accordance with the present invention.

Referring to FIG. 21, yet another paper machine 210 is shown, which is suitably arranged for practicing the present invention. Paper machine 210 includes a forming section 212, a first can drying section 214, crepe roll 216, and a second drying section 218. Section 212 is referred to in the art as a Fourdrinier former. The former includes a head box 220, a forming fabric or wire 222, and a plurality of rollers. Included are forming roll 224, support rolls 226 and 228 and transfer roll 230.

Adjacent to forming section 212 is a first can drying section 214, which includes a dryer fabric 232, as well as a plurality of support rollers. Thus, included are support rolls 234, 236, and 238, as well as a shoe press roll 240 and heated cans 242, 244, 246, 248, 250, 252, and 254.

A transfer roll 260 is provided adjacent to first can drying section 214.

Transfer roll 260 is in contact with an impression fabric 262, which, in turn, is supported by a plurality of rollers, as is seen in the diagram. There is thus provided support rollers 264, 266, 268, and so forth. Roller 268 is advantageously a suction roll. Fabric 262 is also carried on roller 270 and dryer cans 272, 274, 276, 278, 280, 282, 284 and 286 before being wound on reel 288 Guide roll 288 is optionally provided.

In dryer section 218, cans 276, 280 and 284 are in a first tier and cans 274, 278, 282 and 286 are in a second tier. Cans 276, 280 and 284 directly contact the web, whereas cans in the other tier, contact the fabric. In this two tier arrangement where the web is separated from cans 278 and 282 by the fabric, it is sometimes advantageous to provide impingement-air dryers at 278 and 282, which may be drilled cans, such that air flow is indicated schematically at 279 and 283. Impingement-air dryers may be similarly employed in first can dryer section 214, if so desired.

In operation, a paper making furnish at low consistency (less than 1 percent) is provided by way of head box 220 onto wire 222 to form a web 292. The web proceeds through machine 210 in the machine direction indicated by arrows 294 to reel 288.

On forming wire 222, the nascent web increases in consistency up to a consistency of from about 10 to 15 percent. The web is then transferred to fabric 232. Fabric 232 is an impression fabric or a dryer fabric, as described above. The web is then dried as it passes over dryer cans 254, 252, 250, 248, 246, 244, and 242. Note that the web is in direct contact with dryer cans 252, 248, and 244 and is disposed on the fabric, which lies between the web and dryer cans 254, 250, 246 and 242. In other words, the web 292 is in proximity to cans 254, and so forth. It is, however, separated therefrom by the fabric. At this point in the process, the web has an apparently random distribution of fiber orientation.

As the web proceeds in the machine direction and is dried by the cans, it is typically raised to a consistency of from about 30 to about 60 percent before being transferred to transfer roll 260. Transfer roll 260 has a rotating transfer surface 261, rotating at a first speed. The web is transferred from fabric 232 to surface 261 of roll 262 by way of roll 240. Roll 240 may be a shoe press roll and incorporates a shoe (similar to shoe 65, see FIG. 19A) in order to assist in transferring the web. Inasmuch as fabric 232 is an impression fabric or a dryer fabric, there is not a substantial change in the consistency of the web upon transfer to rotating cylinder 260. The transfer occurs in transfer nip 267, whereupon, web 292 is transferred to surface 261 of cylinder 260 and conveyed to impression fabric 262.

Following the creping nip, the web is conveyed on fabric 262 to a plurality of can dryers 272, 274, 276, 278, 280, 282, 284, and 286 in the direction indicated by arrows 294. Preferably, roll 268 is a suction roll in order to prevent loss of adhesion between the fabric and the web. Likewise, roll 270 may be a suction roll, if so desired.

Following drying of the web to a consistency of 90 percent or so, web 292 is transferred from fabric 262 in a transfer nip between a roll 310 and a creping cylinder 312, and adhered to the surface of second creping cylinder 312 with a polyvinyl alcohol containing creping adhesive. Thereafter, the web is creped from cylinder 312, passes over rolls 290, 300 and is wound upon reel 288. Cylinder 312 allows for even more crepe and stretch in the product. If so desired, an undulatory creping blade of the type disclosed and claimed in U.S. Pat. No. 5,690,788 may be used to provide still more bulk to the product.

While the invention has been described in connection with several examples, modifications to those examples within the spirit and scope of the invention will be readily apparent to those of skill in the art. In view of the foregoing discussion, relevant knowledge in the art and references discussed above in connection with the Background and Detailed Description, the disclosures of which are all incorporated herein by reference, further description is deemed unnecessary.

We claim:

1. A method of making a cellulosic web having an elevated absorbency, the method comprising:

(a) forming a nascent web having a random distribution of fiber orientation from a papermaking furnish;

(b) non-compactively drying the nascent web to a consistency of from about 30 percent to about 60 percent;

(c) after the non-compactively drying step, transferring the nascent web to a translating transfer surface that is moving at a transfer surface speed;

(d) fabric-creping the nascent web from the transfer surface at a consistency of from about 30 percent to about 60 percent utilizing a creping fabric, the fabric-creping step occurring under pressure in a fabric creping nip defined between the transfer surface and the creping fabric, wherein the fabric is traveling at a fabric speed that is slower than the transfer surface speed by at least 100 feet per minute, such that the nascent web is creped from the transfer surface and redistributed on the creping fabric to form a creped wet web;

(e) retaining the creped wet web in the creping fabric; and (f) drying the creped wet web, while the creped wet web is held in the creping fabric, to a consistency of at least about 90 percent, to form a dried web.

2. The method according to claim 1, wherein the drying step comprises drying the creped wet web to a consistency of at least about 92 percent, while the creped wet web is held in the creping fabric.

3. The method according to claim 1, wherein the dried web has a cross-machine direction (CD) stretch of from about 5 percent to about 20 percent.

4. The method according to claim 1, wherein the fabric-creping step comprises fabric-creping the web at a consistency of from about 45 percent to about 60 percent.

5. The method according to claim 1, wherein the fabric-creping step comprises fabric-creping the web at a consistency of from about 40 percent to about 50 percent.

6. The method according to claim 1, wherein the fabric-creping step comprises fabric-creping the web at a consistency of from at least about 35 percent.

7. The method according to claim 1, wherein the dried web has an absorbency of at least about 7 g/g.

8. The method according to claim 1, wherein the dried web has an absorbency of at least about 9 g/g.

9. The method according to claim 1, wherein the dried web has an absorbency of at least about 11 g/g.

10. The method according to claim 1, wherein the dried web has an absorbency of at least about 13 g/g.

11. The method according to claim 1, wherein the fabric speed is slower than the transfer surface speed by a velocity delta of up to 2000 feet per minute.

12. The method according to claim 11, wherein the fabric speed is slower than the transfer surface speed by at least 500 feet per minute.

13. A method of making a fabric-creped absorbent cellulosic sheet, the method comprising:

(a) forming a nascent web having a random distribution of fiber orientation from a papermaking furnish;

(b) non-compactively drying the nascent web to a consistency of from about 30 percent to about 60 percent;

(c) after the non-compactively drying step, transferring the nascent web to a translating transfer surface that is moving at a transfer surface speed;

(d) fabric-creping the nascent web from the transfer surface at a consistency of from about 30 percent to about 60 percent utilizing a creping fabric, the fabric-creping step occurring under pressure in a fabric creping nip defined between the transfer surface and the creping fabric, wherein the fabric is traveling at a fabric speed that is lower than the transfer surface speed, such that the nascent web is creped from the transfer surface and redistributed on the creping fabric to form a creped wet web with a reticulum having a plurality of interconnected regions of different fiber orientation, including at least (i) a plurality of fiber enriched regions having an orientation bias in a direction transverse to the machine-direction, interconnected by way of (ii) a plurality of colligating regions whose fiber orientation bias is offset from the fiber orientation of the fiber enriched regions;

(e) retaining the creped wet web in the creping fabric; and (f) drying the creped wet web, while the creped wet web is held in the creping fabric.

14. The method according to claim 13, wherein the drying step comprises drying the creped wet web to a consistency of at least about 92 percent, while the creped wet web is held in the creping fabric.

15. The method according to claim 13, wherein the drying step comprises drying the creped wet web to a consistency of at least about 95 percent, while the creped wet web is held in the creping fabric.

16. The method according to claim 13, wherein the fabric-creping step comprises fabric-creping the nascent web so that the plurality of fiber enriched regions and colligating regions recur in a regular pattern of interconnected fibrous regions throughout the web, in which the orientation bias of the fibers of the fiber enriched regions and colligating regions are transverse to one another.

17. The method according to claim 13, wherein the fibers of the fiber enriched regions are substantially oriented in the cross-machine direction (CD).

18. The method according to claim 13, wherein the plurality of fiber enriched regions have a higher local basis weight than that of the colligating regions.

19. The method according to claim 13, wherein at least a portion of the colligating regions consists of fibers that are substantially oriented in the machine direction (MD).

20. The method according to claim 13, wherein the fabric-creping step comprises fabric-creping the nascent web so that there is a repeating pattern including a plurality of fiber enriched regions, a first plurality of colligating regions whose fiber orientation is biased toward the machine-direction, and a second plurality of colligating regions whose fiber orientation is biased toward the machine-direction, but offset from the fiber orientation bias of the first plurality of colligating regions.

21. The method according to claim 20, wherein the fibers of at least one of the plurality of colligating regions are substantially oriented in the machine direction (MD).

22. The method according to claim 13, wherein the fiber enriched regions exhibit a plurality of U-shaped folds.

23. The method according to claim 13, wherein the creping fabric is provided with cross-machine direction (CD) knuckles defining creping surfaces transverse to the machine-direction.

24. The method according to claim 23, wherein the distribution of the fiber enriched regions corresponds to the arrangement of CD knuckles on the creping fabric.

25. A method of making a fabric-creped absorbent cellulosic web, the method comprising:

(a) forming a nascent web having a random distribution of fiber orientation from a papermaking furnish;

(b) non-compactively drying the nascent web to a consistency of from about 30 percent to about 60 percent;

(c) after the non-compactively drying step, transferring the nascent web to a translating transfer surface that is moving at a transfer surface speed;

(d) fabric-creping the nascent web from the transfer surface at a consistency of from about 30 percent to about 60 percent utilizing a creping fabric, the fabric-creping step occurring under pressure in a fabric-creping nip defined between the transfer surface and the creping fabric, wherein the fabric is traveling at a fabric speed that is lower than the transfer surface speed, such that the nascent web is creped from the transfer surface and redistributed on the creping fabric to form a creped wet web with a reticulum having a plurality of interconnected regions of different local basis weights, including at least (i) a plurality of fiber enriched pileated regions of a high local basis weight, interconnected by way of (ii) a plurality of lower local basis weight linking regions whose fiber orientation is biased toward the direction between pileated regions;

(e) retaining the creped wet web in the creping fabric; and (f) drying the creped wet web, while the creped wet web is held in the creping fabric.

26. The method according to claim 25, wherein the drying step comprises drying the creped wet web to a consistency of at least about 92 percent, while the creped wet web is held in the creping fabric.

27. The method according to claim 25, wherein the drying step comprises drying the creped wet web to a consistency of at least about 95 percent, while the creped wet web is held in the creping fabric.

28. A method of making a cellulosic web having an elevated absorbency, the method comprising:

(a) forming a nascent web having a random distribution of fiber orientation from a papermaking furnish;

(b) rush-transferring the nascent web from a first fabric that is traveling at a first speed to a second fabric that is traveling at a second speed that is slower than the first speed, the rush transfer occurring while the nascent web is at a consistency of from about 10 percent to about 30 percent;

(c) non-compactively drying the nascent web to a consistency of from about 30 percent to about 60 percent;

(d) after the non-compactively drying step, transferring the nascent web to a translating transfer surface that is moving at a transfer surface speed;

(e) fabric-creping the nascent web from the transfer surface at a consistency of from about 30 percent to about 60 percent utilizing a creping fabric, the fabric-creping step occurring under pressure in a fabric creping nip defined between the transfer surface and the creping fabric, wherein the fabric is traveling at a fabric speed that is lower than the transfer surface speed, such that the nascent web is creped from the transfer surface and redistributed on the creping fabric to form a creped wet web;

(f) retaining the creped wet web in the creping fabric; and (g) drying the creped wet web, while the creped wet web is held in the creping fabric.

29. The method according to claim 28, wherein the drying step comprises drying the creped wet web to a consistency of at least about 92 percent, while the creped wet web is held in the creping fabric.

30. The method according to claim 28, wherein the drying step comprises drying the creped wet web to a consistency of at least about 95 percent, while the creped wet web is held in the creping fabric.

31. A method of making a cellulosic web having an elevated absorbency, the method comprising:

(a) forming a nascent web having a random distribution of fiber orientation from a papermaking furnish;

(b) non-compactively drying the nascent web to a consistency of from about 30 percent to about 60 percent;

(c) after the non-compactively drying step, transferring the nascent web to a translating transfer surface that is moving at a transfer surface speed;

(d) fabric-creping the nascent web from the transfer surface at a consistency of from about 30 percent to about 60 percent utilizing a creping fabric, the fabric-creping step occurring under pressure in a fabric creping nip defined between the transfer surface and the creping fabric, wherein the fabric is traveling at a fabric speed that is lower than the transfer surface speed, such that the nascent web is creped from the transfer surface and redistributed on the creping fabric to form a creped wet web;

(e) retaining the creped wet web in the creping fabric; and (f) drying the creped wet web, while the creped wet web is held in the creping fabric, to form a dried web;

(g) transferring the dried web to the surface of a creping cylinder and adhering the dried web to the surface of the creping cylinder with a polyvinyl alcohol containing adhesive; and (h) creping the dried web from the creping cylinder.

* * * * *